US006127109A

United States Patent [19]

Goan

[11] Patent Number: 6,127,109

[45] Date of Patent: Oct. 3, 2000

[54] SILVER HALIDE LIGHT SENSITIVE PHOTOGRAPHIC MATERIAL

[75] Inventor: Kazuyoshi Goan, Hino, Japan

[73] Assignee: Konica Corporation, Japan

[21] Appl. No.: 09/151,160

[22] Filed: Sep. 10, 1998

[30] Foreign Application Priority Data

Sep. 17, 1997 [JP] Japan ..... 9-252077

[51] Int. Cl.[7] ..... G03C 1/035; G03C 1/09

[52] U.S. Cl. ..... 430/567; 430/603; 430/611; 430/966

[58] Field of Search ..... 430/567, 603, 430/611, 966

[56] References Cited

U.S. PATENT DOCUMENTS 5,744,296 4/1998 Ishikawa et al. ..... 430/567
5,807,663 9/1998 Funakubo et al. ..... 430/567
5,851,753 12/1998 Yamada et al. ..... 430/603

*Primary Examiner*—Mark F. Huff
*Attorney, Agent, or Firm*—Jordan B. Bierman; Bierman, Muserlian and Lucas

[57] ABSTRACT

A silver halide light sensitive photographic material is disclosed, comprising a support having thereon hydrophilic colloid layers including a silver halide emulsion layer, wherein (i) at least 50% of the total projected area of silver halide grains contained in the emulsion layer is accounted for by tabular grains having an aspect ratio of 3 to 15, (ii) the tabular grains each comprising an inner region which accounts for 70% by volume of the grain and a residual outer region, the outer region containing at least 75% of total iodide contained in the grain, and (iii) the tabular grains each having an outermost layer, a halide content distribution among the tabular grains with respect to the outermost layer being not more than 20%; and wherein at least one of the hydrophilic colloid layers contains a sulfur containing compound, which has a water-solubilizing group.

17 Claims, No Drawings

SILVER HALIDE LIGHT SENSITIVE PHOTOGRAPHIC MATERIAL

FIELD OF THE INVENTION

The present invention relates to a silver halide light sensitive photographic material with superior processability even when subjected to super-rapid access processing at a low replenishing rate, and a process for forming X-ray photographic images.

Recently, with regard to processing of silver halide light sensitive photographic materials, there have been demands for further reduction of the processing time.

In the field of medical use, for example, the amount of time for X-ray photographing is rapidly increasing due to increased use of X-rays for diagnosis and inspection in general medical examinations, as well as increased popularity of periodical health check-ups and clinical surveys, and the result thereof must be made known as promptly as possible. There is also increased use of arteriography and radiography during surgical operation, in which rapid photographic processing is essential. To satisfy such demands in the area of the diagnosis, it is necessary to promote automation and the enhancing speed of radiographing and processing operation of the light sensitive photographic materials.

Recently, reduced replenishment to processing solutions is also strongly desired. From the view point of environment protection, low replenishment has been advanced to reduce effluents from processing tanks. Especially, disposal of industrial waste in the oceans has been prohibited since 1955 and such trends have become stronger.

In response to demands for rapid access and low-replenishment, it is necessary to tackle these needs as a total system including the photographic material, the processing solution and the processing apparatus. In particular, development of photographic materials to be processed is specifically important.

When subjected to rapid processing, conventional photographic materials led to markedly increase fog and reduced sensitivity, which were not acceptable in practical use.

To solve problems regarding the fog increase and sensitivity reduction, the surface state of silver halide grains is of importance and there have been made a large number of studies thereof. JP-A 3-237451 (herein, the term, JP-A is referred to as unexamined, published Japanese Patent Application) discloses silver halide grains which have a higher iodide content on the surface than in the interior, achieving uniform adsorption of sensitizing dyes and leading to a silver halide emulsion with enhanced sensitivity and improved storage stability. However, the halide composition among grains is not taught therein.

Uniformity among grains is also important and there have also been made a number of studies thereof. JP-A 60-254032 discloses grains comprised of a core containing iodide of 5 mol % or more and a shell containing less iodide and an emulsion with a relative standard deviation of iodide contents among grains of 20% or less, thereby achieving high sensitivity, high contrast and superior graininess. However, there is taught nothing with respect to halide composition of the outermost surface of the grains.

To enhance the developing rate or fixing rate, it is preferable to reduce the silver iodide content of silver halide grains. The reduced silver iodide content on the surface of silver halide grains results in deterioration of adsorption of a spectral sensitizing dye, leading to a lowering of spectral sensitivity or an increase of pressure fog.

Reduction of the coating weight of silver is advantageous in terms of low-replenished processing, so that it is essential to obtain a higher density with a given silver coverage. That is, silver halide grains with a large covering power are needed. To meet this need, it is desirable to employ silver halide grains of a smaller size or tabular silver halide grains with a larger projection area. To employ the silver halide grains of a smaller size, efficient sensitization is needed. The tabular silver halide grains are also preferred in terms of spectral sensitization efficiency or sensitivity.

Recently, techniques for enhancing sensitivity and image quality by the use of tabular silver halide grains were disclosed in JP-A 58-111935, 58-111936, 58-111937, 58-113927 and 59-99433. Further, JP-63-92942 discloses a technique for providing a core with a high silver iodide content in the interior of tabular silver halide grains, and JP-A 63-151618 discloses a technique of employing hexagonal tabular silver halide grains, showing effects of enhancing sensitivity. Furthermore, JP-A 63-106746, 1-183644 and 1-279237 disclose techniques regarding to halide composition of tabular silver halide grains.

However, the tabular silver halide grains have a disadvantage such that pressure resistance characteristics are deteriorated. In general, silver halide grains are sensitive to pressure, and the higher the sensitivity, the more sensitive to pressure, in particulat, the tabular silver halide grains are marked to a noticeable extent. It is reasoned that tabular grains are thinner than a spherical grains with an equivalent volume so that the tabular grains are easily subjected to larger moments and the grains become overall weaker in mechanical strength.

Pressure characteristics depend on conditions of chemical sensitization of the silver halide grains, as well as the grain shape. It is generally known that when the extent of chemical sensitization is insufficient, pressure desensitization is marked; and when the extent of chemical sensitization is excessive, the pressure desensitization is small but pressure fog increases. Specifically, when the tabular grains are subjected to excessive chemical sensitization, problems often occur such as increased pressure fog. Furthermore, when a spectral sensitizing dye is adsorbed thereto, marked pressure fog due to chemical sensitization tends to occur. There have been studies of selenium sensitization and/or tellurium sensitization for enhancing sensitivity, and when these sensitization are applied, the pressure fog also tends to increase.

Accordingly, the tabular silver halide grains are desired to enhance pressure resistance characteristics and lowering pressure fog. There have been a number of studies regarding enhancing pressure resistance characteristics. U.S. Pat. No. 2,628,167 discloses an emulsion containing a thallium salt, thereby improving pressure desensitization and enhancing sensitivity and contrast. Although there is no description with respect to pressure fog, a technique of lowering pressure fog is, in general, to accelerate pressure desensitization so that the technique disclosed is anticipated to increase pressure fog. There are also disclosed means for enhancing pressure resistance characteristics in JP-A 59-994333, 60-35726, 60-147727, 63-301937, 63-149641, 63-106746, 63-151618, 63-220238, 1-131541, 2-193138, 3-172836, 3-231739, 6-266032 and 6-324418, but these means did not achieve sufficient improvements.

Specifically, with regard to spectrally sensitized tabular silver halide grains or selenium/and or tellurium sensitized tabular silver halide grains, an effective means for lowering pressure fog has not yet been found. Further, since there is an antinomy relationship such that a technique of lowering pressure fog is, in general, to accelerate pressure desensitization, it has been difficult to develop a technique for satisfying both needs. Another disadvantage of the tabular grains concerns deterioration of silver color tone. As the grain thickness of silver halide grains decreases, scattering of the blue light component due to filamentary silver formed on development increases, resulting in yellowish transmitted light and silver images becoming yellowish. The color of silver images is called as silver image tone (or color). In photographic materials for medical use, a yellowish silver image tone is not preferred and therefore, development of silver halide grains which are of tabular form and superior in silver image tone, has been desired.

SUMMARY OF THE INVENTION

An object of the present invention is to provide a silver halide light sensitive photographic material superior in rapid processability even when processed at a low replenishment rate and with low fog and high sensitivity.

Another object is to provide a method of forming an X-ray image by processing the silver halide photographic material having such capabilities as described above, through a rapid access which is safe and meeting environmental restrictions.

The above objects of the present invention can be attained by the following constitution:

(1) A silver halide light sensitive photographic material comprising a support having thereon hydrophilic colloid layers including a silver halide emulsion layer, wherein (i) at least 50% of the total projected area of silver halide grains contained in the emulsion layer is accounted for by tabular grains having an aspect ratio of 3 to 15, (ii) said tabular grains each comprising an inner region which accounts for 70% by volume of the grain and a residual outer region, said outer region containing at least 75% of the total iodide contained in the grain, and (iii) said tabular grains each having an outermost layer, a halide content distribution among the tabular grains of the outermost layer being not more than 20%; and wherein at least one of the hydrophilic colloid layers contains a sulfur containing compound which has a water-solubilizing group.

(2) The silver halide photographic material described in (1), wherein the sulfur containing compound having a water-solubilizing group is represented by the following formula (1) or (2):

$$R^1—(S)m—R^2 \qquad \text{formula (1)}$$

wherein $R^1$ and $R^2$ each represent a substituted or unsubstituted aliphatic group, aromatic group or heterocyclic group, provided that at least one of $R^1$ and $R^2$ has a water-solubilizing group and $R^1$ and $R^2$ may combine with each other to form a substituted or unsubstituted ring, and $R^1$ and $R^2$ may the same or different; and m is an integer of 2 to 6, $$R—S(M)y \qquad \text{formula (1)}$$

wherein R represents an aliphatic hydrocarbon group, aromatic hydrocarbon group or heterocyclic group, each of which has a water-solubilizing group; S(M)y represents a group capable of being adsorbed to silver halide, M represents a hydrogen atom, an alkali metal atom or a cationic group, and y is 0 or 1, provided that when y is 0, the formula represents R=S, in which S is linked by a double bond to a carbon atom contained in the R.

(3) The silver halide photographic material described in (1) or (2), wherein the sulfur compound having a water-solubilizing group is contained in the silver halide emulsion layer.

(4) The silver halide photographic material described in any one of (1), (2) and (3), wherein the silver halide photographic material has silver halide emulsion layers on both sides thereof.

DETAILED DESCRIPTION OF THE INVENTION

The halide content distribution among grains with respect to the outermost layer concerns halide(s) other than a halide the content of which (expressed in mol %) is maximum among halides contained in the outermost layer. In the case of silver halide grains having the outermost layer comprised of 60 mol % of silver chloride, 30 mol % of silver bromide and 10 mol % of silver iodide, for example, the bromide content distribution among grains of the outermost layer and the iodide content distribution among grains of the outermost layer are each defined. In cases where two or more halide contents of the outermost layer are defined in a single emulsion, the distribution of at least one of the two or more halide contents, among grains, is 20% or less; and preferably, distributions of two or more halide contents among grains are each 20% or less. The distribution among grains is preferably 12% or less, more preferably 10% or less, and still more preferably 5% or less. Herein, the halide content distribution among grains is defined as standard deviation of the halide content among grains divided by the average halide content of grains times 100%.

In silver halide grains according to the invention, at least 50% of the total grain projected area is accounted for by grains having a silver halide layer containing at least 75% (preferably, at least 80%) of the total iodide contained in the grain within the outer region other than the inner region corresponding to 70% by volume, based on the grain. Further, the outermost surface layer preferably contains silver bromide. The silver bromide content of the outermost surface layer is preferably not less than 20 mol %, and more preferably not less than 50 mol %. The outermost surface preferably contains silver iodide of 0.1 to 10 mol %, more preferably 0.5 to 5 mol %, and still more preferably 1.0 to 5 mol %.

The silver halide grains according to the invention preferably contain a silver bromide and/or silver iodide localizing phase, in the vicinity of the surface and/or in the vicinity of the corner of the grain. The expression "in the vicinity of the surface" means the position within a depth of ⅕ of the grain size (preferably 1/7) from the surface.

The silver bromide localizing phase in the vicinity of the surface and/or in the vicinity of the corner, preferably contains not less than 20 mol % silver bromide, and more preferably not less than 50 mol % silver bromide. The silver iodide localizing layer preferably contains 0.1 to 5 mol % silver iodide.

The halide composition of the outermost surface layer can be determined by a means generally called surface electron spectroscopy such as Auger electron spectroscopy, X-ray photoelectron spectroscopy, or ion scattering spectroscopy, or secondary ion mass spectrometry (hereinafter, also denoted as SIMS). In the invention, in order to determine the halide composition distribution, it is necessary to have spatial resolving power to the extent capable of discriminating each grain. The extent capable of discriminating each grain means that the spatial resolving power of a detecting means is preferably not more than 0.5 of the average diameter of silver halide grains as the object, more preferably not more than 0.2, and still more preferably not more than 0.1. In cases where the detecting probe is a charged particle such as an electron or ion, the spatial resolving power can be enhanced by convergence with a lens. In the case of X-rays, cyclotron radiation ray can be employed by reference to B. M. Gordon and B. Manowitz, US DOE Rep. BNL-46377 (1991). The surface electron spectroscopy is referred to D. Briggs and M. P. Shear "Surface Analysis, Basis and Application" and the ion scattering spectroscopy is referred to L. M. Niedzwiecki and Y. T. Tan, J. Photogr. Sci. 35, 155 (1987). The Auger electron spectroscopy, X-ray photoelectron spectroscopy and ion scattering spectroscopy are referred to Okusa et al. "Surface Analysis of Silver Halide Microcrystals by Photoelectron Spectroscopy" (Proceedings of IS$$T's 47th Annual Conference/May 1994/Rochester N.Y.), in which the measured object needs to be cooled to prevent alteration of silver halide grains during measurement.

The SIMS is a form of destruction analysis so that the measured object need not necessarily be cooled, but in the measurement of the outermost surface layer, the total ion doping amount is indispensable to be $2\times10^{13}$ particles/cm$^2$ or less. Furthermore, as disclosed in "Secondary Ion Mass Spectrometry SIMS VII" p.821, 1990 (John Wiley & Sons), it is necessary to provide a multi-channel detecting system which can simultaneously measure plural kinds of the secondary ions ejected from portions destroyed by the primary ions. It is not preferable to employ a single-channel detecting system, as disclosed in T. J. Maternaghan et al., J of Imag. Sci. 34, 58 (1990). In light of the foregoing, the most preferable SIMS usable in the present invention is Time of Flight type Secondary Ion Mass Spectrometry (hereinafter, also denoted as TOF-SIMS).

Halide composition of the outermost surface layer of silver halide grains can be measured using TOF-SIMS in accordance with the following procedure. In the invention, the halide composition of the outermost surface layer of silver halide grains is one measured in the following manner. Thus, to take out silver halide grains from a silver halide emulsion, in general, the emulsion is treated with proteinase under a safelight to degrade the gelatin used as a dispersing medium, and after centrifuging, the supernatant solution is decanted and washed with distilled water. In cases where silver halide grains are present in a coating layer with a gelatin binder, the gelatin is similarly degraded with proteinase to take out the grains. In cases where a polymer other than gelatin is contained, the polymer can be leached out by using an appropriate organic solvent. In the case of a dyestuff or a sensitizing dye adsorbed onto the grains, these materials can be removed by using an aqueous alkaline solution or an alcohol. The grains dispersed in water is coated on a conductive substrate and dried to be subjected to measurement. It is preferable to arrange the grains without allowing coagulation and it is also preferable to confirm samples obtained according to a series of procedure by optical microscopic or electron microscopic observation. A dispersing aid may be employed to prevent grain coagulation. In this case, generally used anionic surfactants or cationic surfactants are not preferable because theu tend to make the secondary ion strength unstable in the SIMS measurement. An aqueous solution containing gelatin of 0.2% by weight or less is preferably employed. Preferably used is a conductive substrate with a smooth surface which contains no element having a high secondary ion yield, such as an alkaline metal. A mirror polished silicon monocrystal wafer with a low resistivity of 1.0 Ω·cm is preferably employed. A rotary coater or a freeze-dry lyophilizer is optimally employed to arrange the grains on the substrate without causing coagulation.

Preferred ion species used as the primary ion in the TOF-SIMS measurement include liquid metal ion species such as $Au^+$, $In^+$, $Cs^+$ and $Ga^+$, the preferred one of these being $Ga^+$. The secondary ion to be detected is a univalent anion. With respect to silver chloride, silver bromide and silver iodide, $35Cl^-$, $37Cl^-$, $79Br^-$, $81Br^-$ and $127I^-$ are respectively measured.

The primary ion accelerating voltage is preferably between 20 kV and 30 kV and subjected to various adjustments so that the beam diameter measured by the knife edge method is 0.25 μm or less. Exposing conditions such as a beam current and an exposure time are optional, but it is preferable that the total primary ion doping amount is not more than $2\times10^{13}$ particles/m$^2$. The primary beam scanning region is optional, and it is preferable to measure the secondary ion strength on each point on the grain surface at an interval of 0.2 μm or less. For example, when scanning a region of 20 μm×20 μm, measurement is made so as to obtain values at 128 points×128 points. When completing the measurement, the sample is moved to such a position that the beam scanning region is not overlapped and measurement is similarly repeated until completing the measurement of at least 50 grains which are arranged on the substrate without coagulating or contacting with each other. The thus obtained data can be recorded as an arrangement of each of the measuring regions with respect to each of the secondary ions.

The arrangement obtained by the measurement described above is subjected to objective treatment using an appropriate spreadsheet program. Arrangement A representing the number of secondary ions of $35Cl^-$, $37Cl^-$, $79Br^-$, $81Br^-$ and $127I^-$, which are obtained in a single measuring region, that is, $A(35Cl^-)$, $A(37Cl^-)$, $A(79Br^-)$, $A(81Br^-)$ and $A(127I^-)$ are converted to Arrangement B representing the sum of univalent secondary ions of $CL^-$, $Br^-$ and $I^-$, that is, $$B(Cl)=A(35Cl^-)+A(37Cl^-)$$

$$B(Br)=A(79Br^-)+A(81Br^-)$$

$$B(I)=A(127I^-)$$

Then, according to the following relationship, Arrangement C can be obtained, representing two-dimensional distribution of the outermost surface silver chloride content, the outermost surface silver bromide content and the outermost surface silver iodide:

$$C(AgCl\%)=100\times B(Cl)/[B(Cl)+B(Br)+B(I)]$$

$$C(AgBr\%)=100\times B(Br)/[B(Cl)+B(Br)+B(I)]$$

$$C(AgI\%)=100\times B(I)/[B(Cl)+B(Br)+B(I)].$$

The value of each element in the Arrangement is converted to gray scale or color and two-dimensionally represented.

Next, for making correction of phenomenon in which the primary ion beam has a spatial strength distribution and the secondary ion yield is lowered in the surrounding of the grain, a critical value of 50 to 100 counts is defined in the arrangement having a maximum sum of arrangement elements among Arrangement B; from the arrangement elements, one not reaching the critical value is selected; and operation of making zero the corresponding Arrangement C is made to determine new Arrangement C'. The Arrangement C' is an arrangement representing two-dimensional distribution of the outermost surface halide content. Thus, the outermost surface halide content of silver halide grains can be obtained by averaging elements having a value other than zero and forming a group including a hexagon, a triangle, a circle, a square and a rectangle. Similarly, the outermost surface halide contents of at least 50 silver halide grains is determined, and from the average value and standard deviation of the grains, a coefficient of variation (or C.V. value) can be obtained to determine the halide composition distribution among the grains.

In the silver halide emulsion according to the invention is employed silver iodobromide, silver iodochloride or silver iodochlorobromide. In the case when tabular silver halide grains according to the invention have (111) major faces, the silver bromide content is preferably 50 mol % or more. In the case when having (100) major faces, the silver chloride content is preferably 30 mol % or more.

The halide composition of each grain and an average halide composition of overall grains can be determined by means of EPMA (Electron Probe Micro Analyzer). In this method, a sample which is prepared by dispersing silver halide grains so as not to be in contact with each other, is exposed to an electron beam to conduct X-ray analysis by excitation with the electron beam. Thereby, elemental analysis of a minute portion can be done. Thus, halide composition of each grain can be determined by measuring intensities of characteristic X-ray emitted from each grain with respect to silver and iodide. At least 50 grains are subjected to the EPMA analysis to determine their iodide contents, from which the average iodide content can be determined.

It is preferred that the silver halide tabular grains according to the invention have uniformly iodide contents among grains. When the iodide content of grains is determined by the EPMA analysis, a relative standard deviation thereof (i.e., a variation coefficient of the iodide content of grains) is 35% or less, preferably, 20% or less.

In the silver halide emulsion according to the invention, tabular silver halide grains account for at least 50% of the total projected area of silver halide grains contained in the emulsion, and more preferably 70% or more, still more preferably 80 to 100%, and most preferably 90 to 100% is tabular grains. The tabular silver halide grains refers to those having two parallel major faces and a ratio of the grain diameter to the grain thickness (hereinafter, also denoted as an aspect ratio) of 3 or more. The grain diameter is its equivalent circular diameter (i.e., the diameter of a circle having an area equivalent to the projected area of the grain). The grain thickness is referred to as a distance between two parallel major faces. The average aspect ratio of the tabular silver halide grains contained in the silver halide emulsion according to the invention is preferably not less than 3 and not more than 15, more preferably not less than 3 and less than 10, still more preferably not less than 3 and less than 8, and most preferably not less than 3 and less than 5.

The major faces of the tabular silver halide grains according to the invention may be (111) faces or (100) faces. In cases where the major faces are comprised of (111) faces, the tabular silver halide grains are preferably hexagonal. The hexagonal tabular silver halide grains (hereinafter, sometimes, referred to as hexagonal tabular grains) have hexagonal major faces ((111) faces), and having a maximum adjacent edge ratio of 1.0 to 2.0. The expression, "maximum adjacent edge ratio" is referred to as a ratio of a maximum length of edges constituting the hexagon to a minimum edge length. In the invention, if the hexagonal tabular silver halide grains have a maximum adjacent edge ratio of 1.0 to 2.0, the corner of the grain may be roundish. In the case of being roundish, the edge length is defined as a distance between crossing points of an extended straight line of the edge and that of an adjacent edge. The corner may disappear, resulting in round grains. It is preferred that ½ or more of each edge of the hexagonal tabular grains is substantially straight. The a maximum adjacent edge ration is preferably 1.0 to 1.5.

In case where the major faces is comprised of (111) faces, the tabular silver halide grain according to the invention preferably contain two or more twin planes parallel to the major faces. The twin plane can be observed by a transmission electron microscope. Thus, a sample is prepared by coating a silver halide emulsion so that the major faces of the tabular grains contained are oriented substantially in parallel to the support. The sample is cut using a diamond cutter to obtain a slice with about 0.1 μm thick. The presence of the twin plane can be confirmed by observing the slice by a transmission electron microscope.

A spacing between twin planes according to the invention is defined as follows. In the case when the twin planes are two, the spacing between twin planes is a distance between the two twin planes. In the case of three or more twin planes, the pacing between twin planes is the longest distance between twin planes. The spacing between twin planes can be determined according to the following manner. Thus, 100 tabular grains exhibiting section perpendicular to the major faces are selected through transmission electron microscopic observation of the slice and the twin plane spacing of each grain is measured to obtain an average thereof. The average twin plane spacing is preferably not less than 0.008 μm, more preferably not less than 0.010 μm, and still more preferably not less than 0.012 μm and not more than 0.05 μm.

In the case of the major faces comprising (100) faces, the major faces of tabular silver halide grains are in the form of a rectangle or one with rounded corners. An adjacent edge ratio of the rectangle is preferably less than 10, more preferably less than 5, and still more preferably less than 2. The edge length of the rectangle with rounded corners is a length to a crossing point between extension of a straight portion of an edge of the rectangle and that of a straight portion of an adjacent edge. The method of measuring crystal faces of tabular silver halide grains is referred to Tani et al. J. Imag. Sci 29 [5] Sept. 1985.

The tabular silver halide grains may contain dislocation. The dislocation can be directly observed by using a transmission electron microscope at a low temperature, as described in J. F. Hamilton, Phot. Sci. Eng., 57 (1967) and Shiozawa, J. Soc. Phot. Sci. Japan, 35, 213 (1972). Thus, silver halide grains which are taken out from an emulsion without applying pressure in an extent of causing dislocation within the grain, are placed on a mesh for use in electron-microscopic observation and observed by a transmission electron microscope under cooling conditions for preventing damage due to the electron beam (e.g., print-out). In view of the fact that the thicker the grain is, the harder transmission of the electron beam becomes, the use of a high voltage type (i.e., 200 kV or more per 0.25 μm in grain thickness) electron microscope is preferred for definite observation.

The average grain diameter of silver halide grains relating to the invention is preferably 0.15 to 5.0 μm, more preferably 0.4 to 3.0 μm, and still more preferably 0.4 to 2.0 μm. The average grain thickness of silver halide grains relating to the invention is preferably 0.01 to 1.0 μm, more preferably 0.02 to 0.40 μm, and still more preferably 0.02 to 0.30 μm.

The tabular silver halide grains are preferably monodispersed. In other words, a width of grain size distribution is preferably 25% or less, more preferably 20% or less, still more preferably 17% or less, and most preferably 15% or less. The width of the grain size distribution is defined in a relative standard deviation (variation coefficient) of the grain diameter, which is expressed as;

(standard deviation of grain diameter/average grain diameter)× 100=width of grain size distribution (%).

It is also preferred that the tabular silver halide grains be small in grain thickness distribution. In other words, a width of grain thickness distribution is preferably 30% or less, more preferably 25% or less, and still more preferably 20% or less. The width of the grain thickness distribution is defined in a relative standard deviation (variation coefficient) of the grain thickness, which is expressed as:

(standard deviation of grain thickness/average grain thickness)× 100=width of grain thickness distribution (%).

The grain diameter and grain thickness can be optimized so as make photographic characteristics such as sensitivity best. The optimum grain diameter and thickness each depend on other factors constituting the photographic material (e.g., thickness of a hydrophilic colloid layer, degree of hardening, chemical ripening conditions, designed speed of a photographic material, silver coverage).

To obtain the silver halide emulsion according to the invention, it is necessary to enhance uniformity among grains of the surface halide composition. Enhancement of the uniformity among grains of the outermost surface halide composition can be performed at any step of the process of manufacturing a silver halide photographic material, including silver halide grain growth, chemical ripening, coating solution preparation and coating, and preferably at the step from immediately before completing the grain growth to immediately after completing the chemical ripening.

When addition of a silver halide fine grain emulsion is applied in the present invention, the fine grain size is preferably not more than 0.15 μm, more preferably not more than 0.1 μm, and still more preferably not more than 0.06 μm. The fine grain emulsion is added preferably at a temperature of 30 to 80° C., and more preferably 40 to 65° C.

The process of preparing the silver halide emulsion according to the invention will now be explained. The process of preparing the silver halide emulsion containing tabular silver halide grain with (111) major faces comprises preferably the nucleation step, the ripening step and the grain growth step. At any step of after completing nucleation, during or after ripening and during grain growth, it is preferred to interrupt the grain preparation, use formed silver halide grains as seed grains and deposit silver halide on the surface of the seed grains to grow grains. For example, in a process of preparing a silver halide emulsion by supplying aqueous silver salt and halide solutions in the presence of a dispersing medium solution to obtain a silver halide emulsion containing tabular grains with (111) major faces, the process preferably comprises:

(i) a nucleation step, in which the pBr of mother liquor is maintained at 0.7 to 2.5 during a period of from the start of forming silver halide containing 0 to 5 mol % iodide to ½ or more;

(ii) subsequently to the nucleation step, a seed grain forming step, in which a silver halide solvent is contained in the mother liquor in an amount of 10-5 to 2.0 mol per mol of silver halide to form substantially monodispersed silver halide spherical twinned crystal grains, or a seed grain forming step, in which after nucleation, the temperature of the mother liquor is raised to 40 to 80° C. to form silver halide twinned crystal seed grains; and (iii) a crystal grain growth step, in which aqueous silver salt and halide solutions and/or a silver halide fine grain emulsion are further added to grow the seed grains. In this case, the mother liquor is a solution employed in preparation of the silver halide emulsion including a final silver halide emulsion.

During the seed grain formation step, an aqueous silver salt solution may be added for the purpose of adjusting the ripening. The grain growth step of growing silver halide seed grains can be achieved by controlling the pAg, pH, temperature, concentration of the silver halide solvent, silver halide composition and flow rates of silver salt and halide solutions during silver halide precipitation. known silver halide solvents such as ammonia, thioethers and thioureas can be made present in the steps of seed grain formation and grain growth.

As disclosed in JP-A 51-39027, 55-142329, 58-113928, 54-48521 and 58-49938, the tabular silver halide grain according to the invention can be obtained by growing the formed seed grains under the condition that an aqueous soluble silver salt solution and a halide solution are added by the double jet method at a flow rate which is gradually varied in proportion to grain growth without forming a new nucleus and widening the grain size distribution, that is, within a range of 30 to 100% of the rate of causing new nuclei to form.

In preparation of the silver halide emulsion containing tabular grains with (100) major faces, nucleation can be performed under conditions that (100) faces are easily formed, for example, in the presence of an iodide ion or at a low pCl. After nucleation, Ostwald ripening and/or growth are performed to obtain tabular silver halide grains with an intended size and its distribution. Thus, in one preferred embodiment, a silver salt solution, a halide solution containing iodide and a protective colloid solution are added to a first vessel to form nucleus grains, and after nucleus grain formation, the mixture solution is transferred to a second vessel and grain growth is performed therein. In this case, the growth is interrupted and using the formed grain as seed grains, silver halide may be deposited on the seed grains. Thus, to a vessel containing a protective colloid solution and seed grains, silver ions, halide ions and optionally fine silver halide grains are supplied thereto to grow the seed grains.

There is also applicable a process of preparing a silver halide emulsion, comprising the steps of 1) adding a silver salt in the absence of an iodide to start nucleation and 2) subsequently, adding a silver salt in the presence of an iodide to perform nucleation and/or crystal growth, as described in JP-A 9-5909. Thus, the process comprises any one of (a) starting nucleation in the absence of an iodide and subsequently, performing nucleation in the presence of an iodide; (b) starting nucleation in the absence of an iodide and subsequently, performing crystal growth in the presence of an iodide; and (c) starting nucleation in the absence of an iodide and subsequently, performing simultaneously nucleation and crystal growth in the presence of an iodide. In any case, the iodide is not present at the start of nucleation and immediately thereafter, the iodide is made present. Furthermore, there is also applicable a preparation process in which the iodide is not allowed to be present during nucleation and/or immediately thereafter.

Each of the steps is further described in detail.

(1) Nucleation:

To a dispersing medium solution containing a dispersing medium and water were added with stirring silver salt and/or halide solutions to form nucleus grains. The pCl at the start of nucleation is adjusted to 0.5 to 3.5, preferably 1.0 to 3.0, and more preferably 1.5 to 2.5 so as to promote formation of (100) faces. An iodide can be introduced until reached solid solubility of silver iodide and silver chloride. The iodide concentration of the protective colloid solution at the start of nucleation is preferably not more than 10 mol %, more preferably 0.001 to 10 mol %, and still more preferably 0.05 to 10 mol %. A bromide ion may be present in the protective colloid solution at the start of nucleation, as far as not less than 20 mol % of a chloride ion are present therein. The pH is preferably not less than 1.0, more preferably not less than 1.5, and still preferably 2.0 to 8.0. Gelatin and its derivatives are employed as a dispersing medium, and impurity-free gelatin is preferably employed. Of these is preferably employed a low methionine containing gelatin with a content of less than 30 $\mu$mol/g gelatin, and preferably less than 15 $\mu$mol/g gelatin. A low molecular weight gelatin is preferably employed, having a molecular weight of 1,000 to $10\times10^4$, and preferably 2,000 to $6\times10^4$. Gelatin is employed singly or in combination with another kind of gelatin. The dispersing medium concentration is preferably 0.1 to 10% by weight, and more preferably 0.3 to 5% by weight. The addition time of the silver salt solution at nucleation is preferably not less than 5 sec. and less than 1 min., and in the mean while, another kind of a halide may be added thereto. Thus, only a silver salt may be added by the single jet addition, or silver salt and halide solutions may be added by the double jet addition. The temperature is preferably 30 to 90° C., and more preferably 35 to 70° C. The silver amount to be added at nucleation is preferably 0.1 to 10 mol %, based on the total silver.

(2) Ripening:

The process of preparing the silver halide emulsion according to the invention, preferably comprises the step of ripening, sebsequent to the nucleation step. In the ripening step, tabular grains produced at the nucleation step are allowed to grow and other grains allowed to disappear through Ostwald ripening. The ripening temperature is preferably 20 to 90° C., more preferably 30 to 85° C. and still more preferably 40 to 80° C. The temperature at ripening may be kept constantly or varied. The ripening temperature is preferably varied, and more preferably raised. The pCl at ripening is preferably 0.5 to 3.5, and more preferably 1.0 to 3.0. The pH at ripening is preferably 1 to 12, more preferably 2 to 8, and still more preferably 2 to 6. Ripening is performed preferably in the absence of a silver halide solvent, such as ammonia.

(3) Crystal growth:

The process can further comprises the step of crystal growth, subsequent to the ripening step. The pCl at crystal growth is adjusted to the range of 0.5 to 3.5, preferably 1.0 to 3.0, and more preferably 1.5 to 2.5. The pH is preferably 1 to 12, more preferably 2 to 8, and still more preferably 2 to 6. The temperature at crystal growth is preferably 40 to 90° C., more preferably 45 to 80° C., and still more preferably 50 to 75° C. Addition of a silver ion and halide ion is performed by the double jet method of adding silver salt and halide soution, the fine grain supplying method of adding previously prepared fine silver halide grain emulsion, or by their combined method. Of these is preferred the fine grain supplying method. In this case, The fine grain size is preferably 0.15 $\mu$m or less, more preferably 0.1 $\mu$m or less, and still more preferably not more than 0.06 $\mu$m or less.

The growth is interrupted in the course of the growth step and the formed grains, as seed grains are futher grown by depositing silver halide on the seed grains. Thus, to a reactionvessel containing a dispersing medium and seed grains are supplied silver salt and halide solutions or optionally a fine silver halide grain emulsion to allow the seed grains to grow. In the process of preparing a silver halide emulsion according to the invention can be present known silver halide solvents such as ammonia, thioethers and thiourea.

In the process of preparing the silver halide emulsion according to the invention, silver halide grains with an intended size and its distribution can be obtained by growing grains under the condition that an aqueous soluble silver salt solution and a halide solution are added by the double jet method at a flow rate which is gradually varied in proportion to grain growth without forming a new nucleus and widening the grain size distribution due to Ostwald ripening, that is, within a range of 30 to 100% of the rate of forming new nuclei. Another process disclosed in Abstract, item 88 of Annual Meeting of Society of Photographic Science and technology of Japan is also preferable, in which a fine silver halide grain emulsion is added, dissolved and recrystalized to grow grains. In this case, fine silver iodide grains, fine silver bromide grains, fine silver iodobromide grains, fine bromochloride grains or fine silver chloride grains are preferred.

Silver halide grains relating to the invention may be so-called halide conversion type grains. The halide conversion amount is preferably 0.2 to 5 mol %, based on the silver amount. The conversion may be conducted during or after physical ripening. An aqueous solution of a halide, of which solubility product with silver is less than that of a halide component on the surface of silver halide grains before subjected to conversion, or corresponding fine silver halide grain emulsion, is conventionally added. In the latter case, the fine grain size is preferably 0.2 mm or less, and more preferably 0.02 to 0.1 $\mu$m.

In the process of preparing the silver halide emulsion according to the invention is of importance stirring conditions during the process. A stirring apparatus disclosed in JP-A 62-160128 is preferred, in which a liquid-introducing nozzle is submerged near an intake of the mother liquor. The stirring rotation number is preferably 100 to 1200 rpm. Details of the supersaturating factors described above are referred to JP-A 63-92942 and 1-213637.

The compound represented by formula (1) is now further described. The aliphatic group represented by $R^1$ and $R^2$ of formula (1) includes a straight-chained or branched alkyl, alkenyl, alkynyl or cycloalkyl group having 1 to 30 carbon atoms, and preferably 1 to 20 carbon atoms, such as methyl, ethyl, propyl, butyl, hexyl, decyl, isopropyl, t-butyl, 2-ethylhexyl, allyl, 2-butenyl, 7-octenyl, propargyl, 2-butynyl, cyclopropyl, cyclopentyl, cyclohexyl and cyclododecyl. The aromatic group represented by $R^1$ and $R^2$ of formula (1) includes one having 6 to 20 carbon atoms, such as phenyl, naphthyl and anthranyl groups. The heterocyclic group represented by $R^1$ and $R^2$ of formula (1) may be monocyclic or condensed cyclic one, including a 5 or 6-membered heterocyclic ring containing at least one of O, S and N atoms. Examples thereof include pyrolidine, piperidine, tetrahydrofuran, tetrahydropyran, oxirane, morphorine, thiomorphorine, furfuryl, thiopyrane, tetrahydrothiophene, pyrrole, pyridine, furan, thiphene, imidazole, pyrazole, oxazole, thiazole, isooxazole, isothiazole, triazole, tetrazole, thiadiazole, oxadiazole, and their benzelogs. The ring formed by combination of $R^1$ and $R^2$ includes 4 to 7-membered rings. Preferable are 5 to 7-membered rings. Preferable R1 and R2 are each a heterocyclic group, and more preferably an aromatic heterocyclic group. The aliphatic group, aromatic group and hetocyclic group may be substituted. Examples of substituents include a halogen atom (e.g., chlorine atom, bromine atom), an alkyl group (e.g., methyl, ethyl, isopropyl, hydroxyethyl, methoxyethyl, trifluoromethyl, t-butyl), a cycloalkyl group (e.g., cyclopentyl, cyclohexyl), an aralkyl group (e.g., benzyl, 2-phenethyl), an aryl group (e.g., phenyl, naphthyl, p-tolyl, p-chlorophenyl), an alkoxy group (e.g., methoxy ethoxy, isoproxy, n-butoxy), an aryloxy group (e.g., phenoxy), cyano group, an acylamino group (e.g., acetylamino, propionylamino), an alkylthio group (e.g., methylthio, ethylthio, n-butylthio), an arylthio group (e.g., phenylthiol, an sulfonylamino group (e.g., methanesulfonylamino, benzenesulfonylamino), an ureido group (e.g., 3-methylureido, 3,3-dimethylureido, 1,3-dimethylureido), an sulfamoylamino group (e.g., dimethylsulfamoylamino), an carbamoyl group (e.g., methylcarbamoyl, ethylcarbamoyl, dimethylcarbamoyl), a sulfamoyl group (e.g., ethylsulfamoyl, dimethylsulfamoyl), an alkoxycarbonyl group (e.g., methoxycarbonyl, ethoxycarbonyl), an aryoxycarbonyl group (e.g., phenoxycarbonyl), an sulfonyl group (e.g., methanesulfonyl, butanesulfonyl, phenylsulfonyl), an acyl group (e.g., acetyl, propanoyl, butyloyl) an amino group (e.g., methylamino, ethylamino, dimethylamino), hydroxy, nitro, nitroso, an amineoxide group (e.g., pyridine-oxide), an imido group (e.g., phthalimido), a disulfide group (e.g., benzenedisulfide, benzothiazolyl-2disulfide) and a heterocyclic group (e.g., pyridyl, benzimidazolyl, benzthiazolyl, benzoxazolyl). m is an interger of 2 to 6, preferably 2 to 5 and more preferably 2.

Further, at least one of $R^1$ and $R^2$ has a water-solubilizing group. Examples of the water-solubilizing group include $—SO_3M^1$, $—COOM^1$, —OH, $—NHR^3$ and a N-attached oxide group in which $M^1$ is a hydrogen atom, an alkali metal atom or a cation. $R^3$ represents a hydrogen atom, an alkyl group having 1 to 6 carbon atoms, $—COR^4$, $—COOR^4$ or $—SO_2R^4$, in which $R^4$ represents a hydrogen atom, an aliphatic group or aromatic group as defined in $R^1$ and $R^2$. Of these, $—SO_3M^1$, $—COOM^1$, —OH and $—NHR^3$ are preferable, and $—COOM^1$ is more preferable. One or more water-solubilizing groups may be contained in $R^1$ or $R^2$.

Exemplary examples of the compound represented by formula (1) are shown below, but the compound is not limited to these examples.

1-1

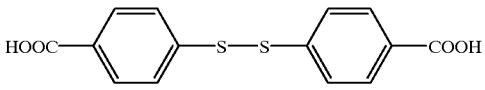

1-2

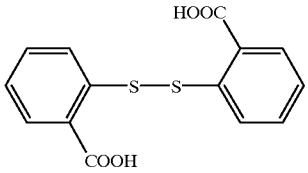

1-3

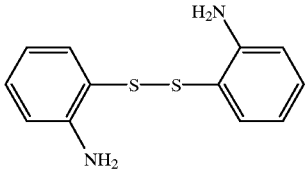

-continued 1-4

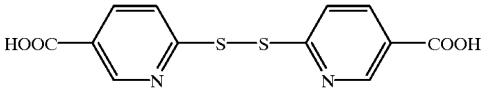

1-5

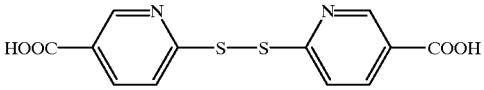

1-6

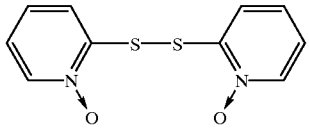

1-7

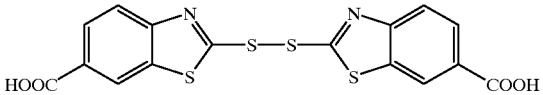

1-8

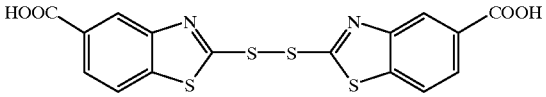

1-9

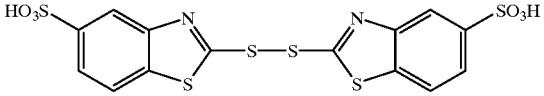

1-10

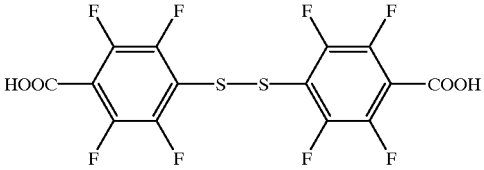

1-11

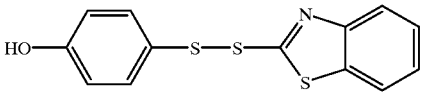

1-12

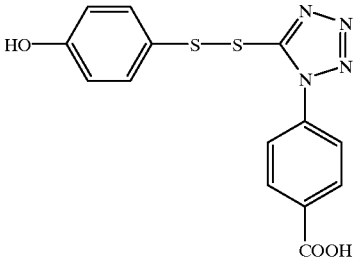

1-13

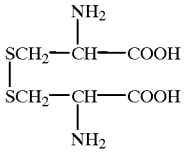

-continued 1-14

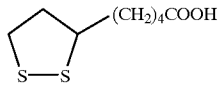

1-15

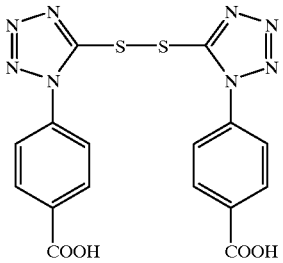

1-16

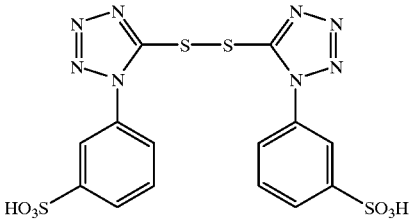

1-17

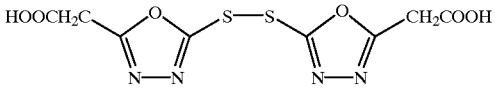

1-18

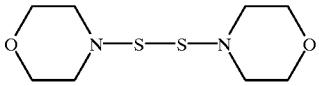

1-19

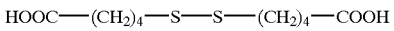

1-20

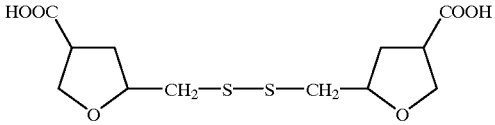

1-21

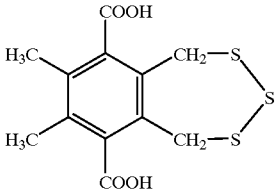

1-22

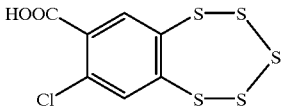

-continued 1-23

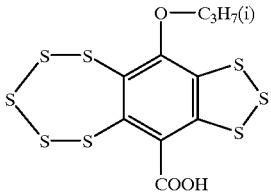

1-24

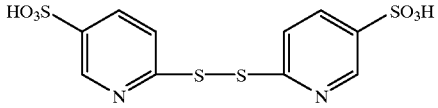

1-25

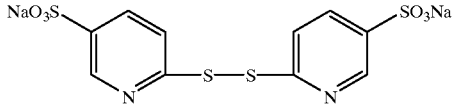

1-26

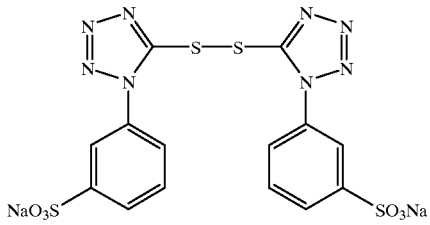

Compounds described above can be readily synthesized in accordance with the method described in J. Pharm. Belg., 22(5–6) 213–219 (1967); U.S. Pat. No. 3,759,932; J. Org. Chem., Vol 23, 64–66 (1967); and J. med. Chem., Vol.10, No.6, 1170–1172.

The compound represented by formula (2) is further described below. In the formula (2), examples of the water-solubilizing group contained in R include —$SO_3M^1$, —$COOM^1$, —OH and —$NHR^3$, in which $M^1$ is a hydrogen atom, an alkali metal atom or a cation. $R^3$ represents a hydrogen atom, an alkyl group having 1 to 6 carbon atoms, —$COR^4$, —$COOR^4$ or —$SO_2R^4$, in which $R^4$ represents a hydrogen atom, an aliphatic group or an aromatic group. Of these is preferred —$COOM^1$. One or more water-solubilizing groups may be contained in R.

The aliphatic hydrocarbon group, aromatic hydrocarbon group and heterocyclic group represented by R are the same as defined in $R^1$ and $R^2$ described above. R is preferably the aromatic hydrocarbon group of a heterocyclic group.

The aliphatic group, aromatic group and hetocyclic group represented by R may be substituted. The substituent is the same as defined in $R^1$ and $R^2$. R can contain one or more of the substituents described above. The substituents each may be further substituted. Specifically, it is preferred that the substituent is substituted by an electron withdrawing group.

In formula (2), S(M)y represents a group capable of being adsorbed to silver halide. M represents a hydrogen atom, an alkali metal atom or a cationic group, and preferably a hydrogen atom or an alkali metal; and y represents 0 or an integer of 1 or more (and preferably 0 or 1), provided that when y is 0, the formula represents R=S.

Exemplary examples of the compound represented by formula (2) are shown below, but the compound is not limited to these examples.
2-1
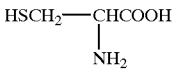
2-2
$HSCH_2CH_2COOH$
2-3
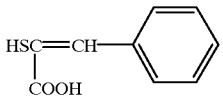
2-4
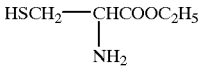
2-5
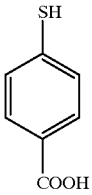
2-6
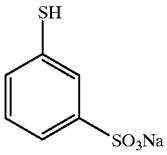
2-7
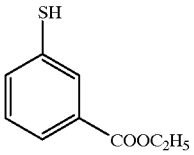
2-8
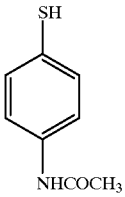
2-9
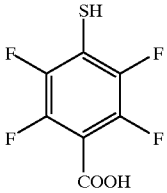
-continued
2-10
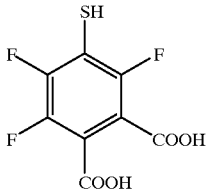
2-11
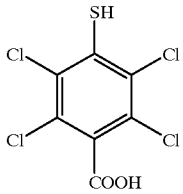
2-12
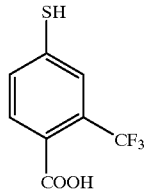
2-13
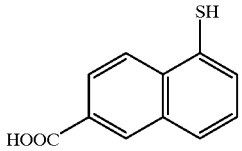
2-14
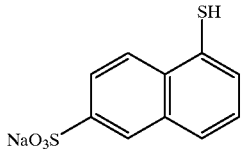
2-15
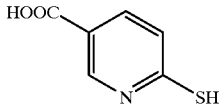
2-16
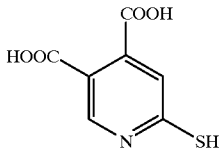
2-17
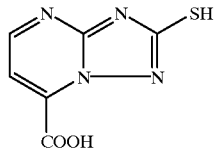

-continued
2-18
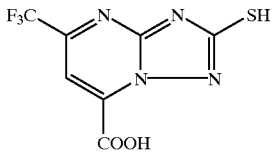
2-19
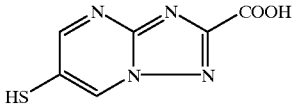
2-20
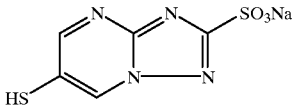
2-21
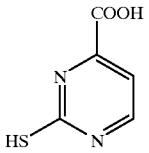
2-22
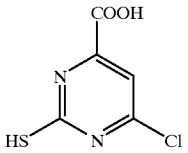
2-23
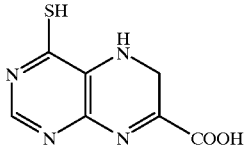
2-24
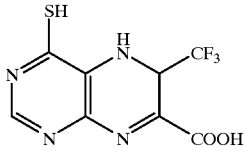
2-25
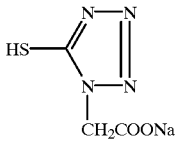
-continued
2-26
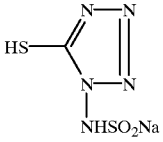
2-27
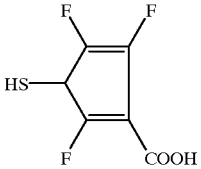
2-28
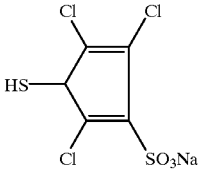
2-29
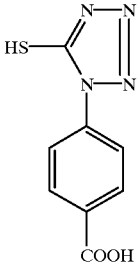
2-30
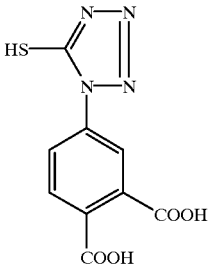
2-31
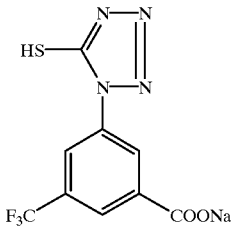
2-32
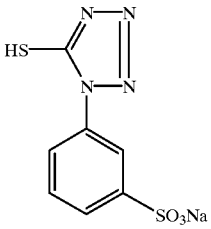

-continued 2-33

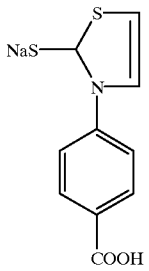

2-34

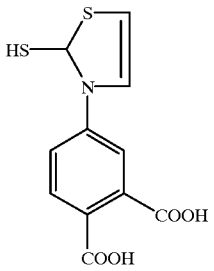

2-35

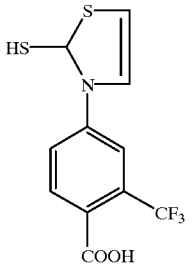

2-36

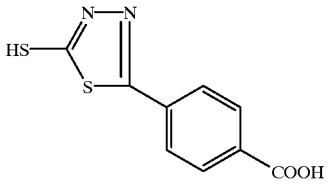

2-37

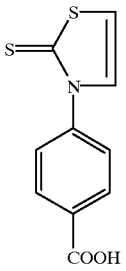

-continued 2-38

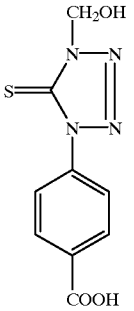

2-39

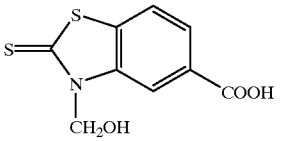

2-40

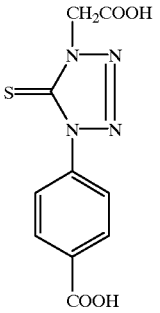

2-41

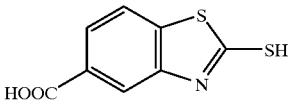

2-42

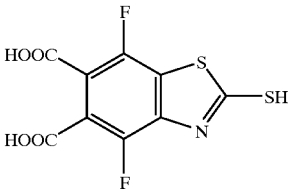

The compound represented by formula (1) or (2) can be incorporayed into an emulsion layer and/or a non-emulsion layer before, during or after chemical sensitization. The amount to be incorporated is preferably 0.1 to 500 mg/m2, and more preferably 1 to 300 $m^2$. The compound can be incorporated by dissolving in a water-miscible organic solvent (e.g., methanol) or in the form of fine particles dispersed in a gelatin aqueous solution. The compound can be present in the form of a silver compound in the emulsion layer or the photographic material.

In cases where after completing crystal growth, a fine silver halide grain emulsion is added, it is preferable to enhance solubility of silver halide grains of substrate. Accordingly, it is preferred to employ a technique of raising the temperature of an emulsion containing the silver halide grains of substrate, vary the pAg or the pH, or add a silver halide solvent. When the temperature is raised, it is preferably 3 to 30° C., and more preferably 7 to 20° C. higher than that at the crystal step. The pAg range, a preferred range of which depends of conditions including halide composition and crystal habit, can be adjusted by adding a halide aqueous solution or a silver salt aqueous solution. The pH can also be adjusted with an appropriate acid or alkali. The silver halide solvent includes known silver halide solvent such as ammonia, thioethers, thioureas, thicyanates.

In the invention it is preferred to enhance uniformity among grains of halide composition of the outermost surface of silver halide grains, in the stage of chemical ripening. Various methods are applicable, including a technique of adding to an emulsion containing silver halide grains of substrate, a fine silver halide grain emulsion containing at least one of fine silver iodide grains, fine silver bromide grains, fine silver chloride grains, fine silver iodobromide grains, fine silver iodochloride grains, fine silver chlorobromide grains and fine silver iodochlorobromide grains; a technique of adding an aqueous solution containing at least one of alkali iodide, alkali bromide and alkali chloride; and a technique of using a halide ion releasing agent. Of these are preferred the addition of a fine silver halide emulsion and the use of a halide ion releasing agent. Herein the chemical ripening stage refers to the period of from the time of completing physical ripening and desalting of a silver halide emulsion, through addition of a chemical sensitizer, to the time of applying an operation of stopping chemical ripening. The fine silver halide grain emulsion or the halide ion releasing agent may be added separately at intervals. After adding the fine grains or the releasing agent, another chemically ripened emulsion may be added. The fine silver halide grain size is preferably 0.15 $\mu$m or less, more preferably 0.1 $\mu$m or less, and still more preferably 0.06 $\mu$m or less. The fine silver halide grain emulsion is added preferably at 30 to 80° C., and more preferably 40 to 65° C.

During the course of forming silver halide grains used in the invention, silver nuclei can be formed. The silver nuclei can be formed by adding a reducing agent to an emulsion or a mixing solution used for grain growth; or by causing grains to grow or ripen at a low pAg of 7 or less or a high pH of 7 or more. A combination these methods is a preferred embodiment of the invention.

As a technique for forming silver nuclei, reduction sensitization has been known, as described in J. Phot. Sci. 25, 19–27 pages (1977) and Phot. Sci. Eng. 32, 113–117 pages (1979). As described by Michell and Lowe in Photo. Korr. Vol 1, 20 (1957) and Phot. Sci. Eng. 19, 49–55 (1975), it has been considered that silver nuclei formed through reduction sensitization contribute sensitization through the following reaction on exposure:

Preferred reducing agents include thiourea dioxide, ascorbic acid and its derivative, and a stannous salt. In addition, borane compounds, hydrazine derivatives, formamidinesulfinic acid, silane compounds, amines or polyamines, and sulfites are also appropriate reducing agents. The reducing agent is added in an amount of $10^{-2}$ to $10^{-8}$ mol per mol of silver halide.

To carry out ripening at a low pAg, there may be added a silver salt, preferably aqueous soluble silver salt. As the aqueous silver salt is preferably silver nitrate. The pAg in the ripening is 7 or less, preferably 6 or less and more preferably 1 to 3 (herein, $pAg=-\log[Ag^+]$).

Ripening at a high pH is conducted by adding an alkaline compound to a silver halide emulsion or mixture solution for growing grains. As the alkaline compound are usable sodium hydroxide, potassium hydroxide, sodium carbonate, potassium carbonate and ammonia. In a method in which ammoniacal silver nitrate is added for forming silver halide, an alkaline compound other than ammonia is preferably employed because of lowering an effect of ammonia.

The silver salt or alkaline compound may be added instantaneously or over a period of a given time. In this case, it may be added at a constant rate or accelerated rate. It may be added dividedly in a necessary amount. It may be made present in a reaction vessel prior to the addition of aqueous-soluble silver salt and/or aqueous-soluble halide, or it may be added to an aqueous halide solution to be added. It may be added apart from the aqueous-soluble silver salt and halide.

In the invention, an oxidizing agent may be used for the silver halide emulsion. The following oxidizing agents can be used:

Hydrogen peroxide and its adduct (e.g., $NaBO_2$—$H_2O_2$—$3H_2O$, $2NaCO_3$—$3H_2O_2$, $Na_4P_2O_7$—$2H_2O_2$, $2Na_2SO_4$—$H_2O_2$—$H_2O$), peroxy acid salt (e.g., $K_2S_2o_8$, $k_2C_2O_6$, $K_4P_2O_8$), $K_2[Ti(O_2)C_2O_4]3H_2O$.

In addition, peracetic acid, ozone, iodine, bromine and thiosulfonic acid type compound are also usable.

The addition amount of the oxidizing agent depends on kind of a reducing agent, conditions for forming silver nuclei, addition time and conditions of the oxidizing agent, and is preferably $10^{-2}$ to $10^{-5}$ mol per mol of silver halide.

The oxidizing agent may be added at any step during the course of preparing silver halide emulsion The oxidizing agent may be added prior to addition of the reducing agent. After adding the oxidizing agent, a reducing agent may newly added to deactivate a oxidizing agent in excess. The reducing agent, which is capable of oxidizing the above oxidizing agent, includes sulfinic acids, di- or trihydroxybenzenes, chromanes, hydrazines or hydrazides, p-phenylenediamines, aldehydes, aminophenols, ene-diols, oximes, reducing sugars, phenidones, sulfites and ascorbic acid derivatives. The reducing agent is added in an amount of $10^{-3}$ to $10^{3}$ mol per mol of silver halide.

Heavy metal ions usable in the invention are preferably Group VIII metal elements of the periodic table, such as iron, iridium, platinum, paradium, nickel, rhodium, osmium, ruthenium and cobalt; Group II metal elements, such as cadmium, zinc and mercury; lead, molybdenum, tungsten, chromium. Among these, transition metal ions, such as iron, iridium, platinum, ruthenium and osmium are preferred. The heavy metal ion may be to a silver halide emulsion in the form of a salt or a complex salt. In particular, addition in the form of a complex salt is preferred, since it is easily incorporated in the grain, resulting in larger effects. In cases where the heavy metal ion forms a complex, examples of ligands include a cyanide, thiocyanate, isothiocyanate, cyanate, chloride, bromide, iodide, carbonyl, and ammonia. Among these, thiocyanate, isothiocyanate and cyanate are preferred. The heavy metal ion may be contained in silver halide emulsion grains by adding a heavy metal compound at a time before, during, or after forming silver halide grains and during physical ripening. For example, the heavy metal compound is added, in the form of a aqueous solution, at a desired timing. It may be contained in silver halide, and the resulting silver halide is continuously added over a period of forming silver halide grains. The heavy metal is added in an amount of $1\times10^{-9}$ to $1\times10^{-2}$ and preferably, $1\times10^{-8}$ to $1\times10^{-3}$ mol per mol of silver halide.

The amount of a hydrophilic binder contained in a silver halide emulsion layer is preferably 3.0 g/m$^2$ or less, and more preferably 1.0 to 2.0 g/m$^2$ or less, in cases where the emulsion layer is coated on both sides of the support. In cases where coated on one side of the support, it is 6.0 g/m$^2$ or less,and more preferably 4.0 g/m$^2$ or less.

The silver halide light sensitive photographic material according to the invention includes a silver halide black-and-white photographic material (e.g., a photographic material for medical use, photographic material for use in graphic art, negative photographic camera material), a color photographic material (e.g., a color negative photographic material, color reversal photographic material, color photographic material for print, a diffusion transfer photographic material and a heat-developable photographic material. Of these is preferable the silver halide black-and-white photographic material, and more preferably the photographic material for medical use.

The silver halide emulsion layer or light-insensitive hydrophilic colloid layer of the photographic material according to the invention preferably contains an organic or inorganic hardener. Examples of the hardener include chromates (e.g., chromium alum, chromium acetate), aldehydes (e.g., formaldehyde, glyoxal, glutar aldehyde), N-methylol compounds (e.g., dimethylol urea, methylol dimethylhydantoin), dioxane derivatives (e.g., 2,3-dihydoxydioxane), active vinyl compounds {e.g., 1,3,5-triacryloyl-hexahydro-s-triazine, bis(vinylsulfonyl)methyl ether, N,N'-methlenebis[β-(vinylsulfonyl)propioneamide]}, muco-halogenic acids (e.g., mucochloric acid, mucophenoxychloric acid), isooxazoles, and 2-chloro-6-hydroxytriazinylated gelatin. These hardener can be employed singly or in combination. The hardener is preferably added in the coating stage of the photographic material, in an optimal amount so as to adjust the swelling ratio in the process of developing, fixing and washing, whereby the water content of the photographicmaterial prior to drying is reduced andsuitability for rapid access is provided.

Support usable in the silver halide photographic material according to the invention include those described in RD-17643 on page 28 and RD-308119 on page 1009. An appropriate support is a plastic resin film. The surface of the support may be provided with a sublayer, or subjected to corona discharge or UV ray exposure to improve adhesive property of a coating layer.

A variety of adjuvants may be incorporated to the photographic material in accordance with its purpose. The adjuvants are described in Research Disclosure (RD) 17643 (December., 1978), ibid 18716 (November., 1979), and ibid 308119 (December., 1989). Kinds of compounds described in these RD and described section are shown below.

| | RD-17643 | | RD-18716 | RD-30 | |
|---|---|---|---|---|---|
| Additive | Page | Sec. | Page | Page | Sec. |
| Chemical sensitizer | 23 | III | 648 upper right | 996 | III |
| Sensitizing dye | 23 | IV | 648–649 | 996–8 | IVA |
| Desensitizing dye | 23 | IV | | 998 | IVB |
| Dye | 25–26 | VIII | 649–650 | 1003 | VIII |
| Developing accelerator | 29 | XXI | 648 upper right | | |
| Antifoggant/stabilizer | 24 | IV | 649 upper right | 1006–7 | VI |
| Brightening agent | 24 | V | | 998 | V |
| Hardening agent | 26 | X | 651 left | 1004–5 | X |
| Surfactant | 26–27 | XI | 650 right | 1005–6 | XI |
| Plasticizer | 27 | XII | 650 right | 1006 | XII |
| Slipping agent | 27 | XII | | | |
| Matting agent | 28 | XVI | 650 right | 1008–9 | XVI |
| Binder | 26 | XXII | | 1003–4 | IX |
| Support | 28 | XVII | | 1009 | XVII |

The photographic material of the invention is processed by use of processing solutions described in RD-17643, XX–XXI, pages 29–30 and RD-308119, XX–XI, pages 1011–1012.

Dihydroxybenzenes such as hydroquinone, 3-pyrazolidones such as 1-phenyl-3-pyrazolidone and aminophenols such as N-methyl-aminophenol are used singly or in combination thereof, as a developing agent used in black-and-white photography. A developing solution may optionally contain a preserver, alkali agent, pH buffering agent, antifoggant, hardener, development accelerating agent, surfactant, defoamer, toning agent, water-softener, dissolving aid or thickener.

A fixing agent such as a thiosulfate or thiocyanate is used in a fixer. Further, a water soluble aluminum salt such as aluminum sulfate or potassium alum may be contained as a hardener. In addition, preserver, pH-adjusting agent, water-softener may be contained.

In an automatic processor used in the invention which has mechanism of supplying a solid processing composition to a processing bath, known methods disclosed in Japanese Utility Model open to public inspection (OPI) publication 63-137783, 63-97522 and 1-85732 are available as a supplying means, in the case of the solid processing composition in a tablet form. If at least function for supplying the tablet to a processing bath is provided, any method may be usable. In the case of a solid processing composition in the form of granules or powder, gravity drop system described in Japanese Utility Model OPI publication 62-81964, 63-84151 and 1-292375, and screw-driving system described in Japanese Utility Model OPI publication 63-105159 and 63-195345 are known methods, but the present invention is not limited to these methods. The solid processing composition may be dropped in any portion of a processing bath. It is preferably the portion which is connected to a processing section and in which a processing solution flows to the processing portion. It is more preferably a structure in which a given amount of the processing solution circulates between the connected portion and the processing section and dissolved components are transferred to the processing section. The solid processing composition is preferably dropped into a temperature-controlled processing solution.

Dihydroxybenzenes described in JP-A 6-13859, aminophenols, pyrazolidones and reductones are usable, as a developing agent, in a developer used in a processing method relating to the present invention. Among the pyrazolidones are preferred those substituted at the 4-position (Dimezone, Dimezone-S), which are water soluble and superior in storage stability when used in the form of the solid composition.

The developing solution used in the invention may contain, as a preservative, an organic reducing agent as well as a sulfite described in JP-A 6-138591. Compounds described in JP-A 5-289255 and 6-308680 (general formulas 4-a and 4-b) may be contained as an antisludging agent. Addition of a cyclodextrin compound is preferred, particularly as described in JP-A 1-124853.

An amine compound may be added to the developing solution, as described in U.S. Pat. No. 4,269,929. A buffering agent may be used in the developing solution, including sodium carbonate, potassium carbonate, potassium bicarbonate, trisodium phosphate, tripotassium phosphate, dipotassium phosphate, sodium borate, potassium borate, sodium tetraborate, potassium tetraborate, sodium o-hydroxybenzoate (sodium salicylate), potassium o-hydroxybenzoate (potassium salicylate), sodium 5-sulfo-2-hydroxybenzoate (sodium salicylate) and potassium 5-sulfo-2-hydroxybenzoate (potassium salicylate).

Thioether compounds, p-phenylenediamine compounds, quaternary ammonium salts, p-aminophenols, amine compounds, polyalkylene compounds; 1-phenyl-3-pyrazolidones; hydrazines, mesoion type compound and imidazoles may be added as a development accelerating agent. Alkali metal halides such as potassium iodide are used as a antifoggant. Organic antifoggants include benzotriazole, 6-nitrobenzimidazole, 5-nitrobenzimidazole, 5-methylbenzotriazole, 5-nitrobenzotriazole, 5-chlorobenzotriazole, 2-thiazolyl-benzimidazole, 2-thiazolylmethyl-benzimidazole, indazole, hydroxyazaindolizine, adenine and 1-pheny-5-mercaptotetrazole.

Further, methylcellosolve, methanol, acetone, dimethylformamide, cyclodextrin compounds compounds described in Japanese Patent 47-33378 and 44-9509 can be optionally used as an organic solvent for enhancing the solubility of a developing agent. Furthermore, a variety of additives, such as an anti-staining agent, antisludging agent and interlayer effect-promoting agent can be used.

A fixer usable in the invention includes compounds known as the fixer. There can be added a fixing agent and a pH buffering agent, a hardener or a preservative. Furthermore, a bisulfite adduct of a hardening agent or known fixing accelerator can also be added.

Prior to processing, an addition of a starter is preferred. The starter is added preferably in a solid form. As the starter are employed organic acids such as polycarboxylic acid, alkali-earth metal halide such as KBr, organic restrainer and developing accelerator.

There may be used an automatic processor in which a mechanism of providing water or acidic rinsing solution between a developing bath and a fixing bath or the fixing bath and a washing bath, as disclosed in JP-A 3-264953. A device for preparing a developer or fixer may be built therein. The photographic material may be processed with conventional processing solutions without use of solid processing composition.

The photographic material according to the invention can be processed with a developer and/or developer replenishing solution containing a compound represented by formula (3).

The compound may be added to a developer in an amount of 0.005 to 0.5, preferably 0.02 to 0.4 mol per liter of the developer. Next, the compound represented by formula (1) will be explained more in detail.

In the formula, $R^1$ and $R^2$ each represent a hydroxy group, amino group, acylamino group, alkylsulfonylamino group, arylsulfonylamino group, alkoxycarbonylamino group, mercapto group and alkylthio group; Z represents a group of atoms necessary for forming a 5 or 6-membered ring.

Concretely, $R^1$ and $R^2$ independently represent a hydroxy group, amino group (which may be substituted by an alkyl group having 1 to 10 carbon atoms such as methyl, ethyl, n-butyl or hydroxyethyl), acylamino group (i.e., acetyl amino, benzoylamino, etc.); alkylsulfonylamino group (e.g., methanesulfonylamino); arylsulfonylamino group (benzenesulfonylamino, p-toluenesulfonylamino, etc.); alkoxycarbonylamino group (methoxycarbonylamino group etc.); mercapto group; alkylthio group (methylthio, ethylthio etc.). As preferred examples of $R^1$ and $R^2$ are cited a hydroxy group, amino group, alkylsulfonylamino group and arylsulfonylamino group. The ring is 5 or 6-membered one including two vinyl carbon substituted by $R^1$ and $R^2$, and carbonyl carbon. Z is a 5- or 6-membered ring, preferably comprised of a carbon atom, oxygen atom or nitrogen atom. Thus, Z is comprised of a combination of —O—, —C($R^3$)($R^4$)—, —C($R^5$)=, —C(=O)—, —N($R^6$)—, and —N=, in which $R^3$, $R^4$, $R^5$ and $R^6$ independently represent a hydrogen atom, alkyl group having 1 to 10 carbon atoms (which may be substituted by a hydroxy, carboxy or sulfo group), aryl group having 6 to 15 carbon atoms (which may be substituted by an alkyl group, halogen atom, hydroxy, carboxy or sulfo group), hydroxy group or carboxy group. The 5- or 6-membered ring includes saturated or unsaturated condensed ring. Examples of the 5- or 6-membered ring include a dihydrofuranone ring, dihydropyrrone ring, pyranone ring, cyclopentenone ring, cyclohexenone ring, pyrrolinone ring, pyrazolinone ring, pyridone ring, azacyclohexenone ring, and uracil ring. Among these are preferred a dihydrofuranone ring, cyclopentenone ring, cyclohexenone ring, pyrazolinone ring, azacyclohexenone ring and uracil ring. Examples of the compounds represented by formula (1) are shown as below, but the present invention is not limited thereto.

3-1

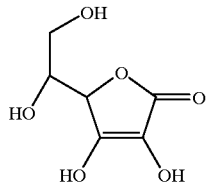

3-2

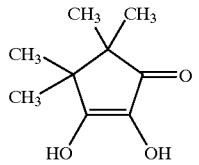

3-3

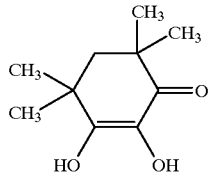

3-4

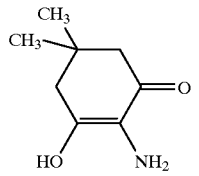

3-5

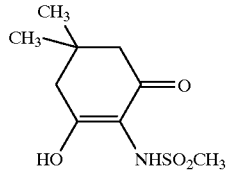

3-6

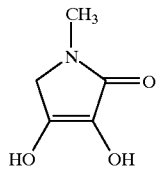

-continued
3-7
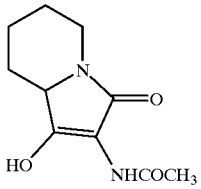
3-8
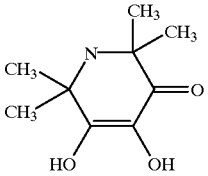
3-9
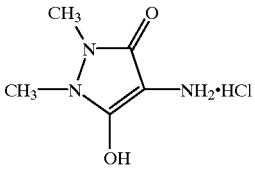
3-10
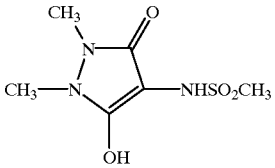
3-11
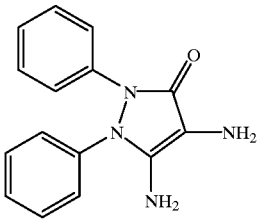
3-12
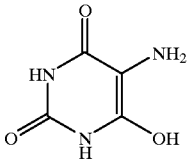
3-13
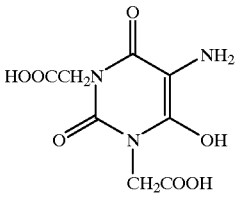
-continued
3-14
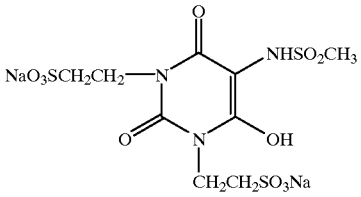
3-15
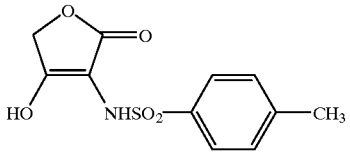
3-16
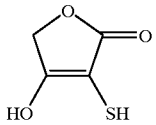
3-17
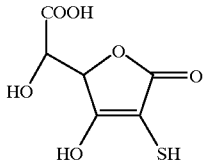
3-18
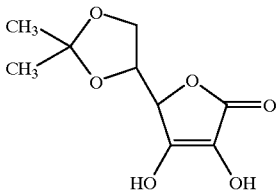
3-19
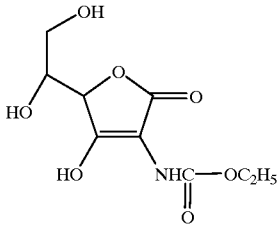
3-20
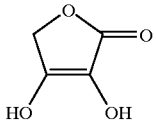
3-21
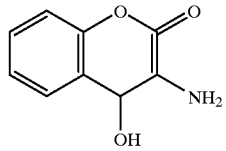

-continued 3-22

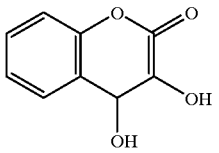

3-23

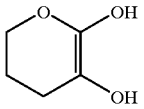

3-24

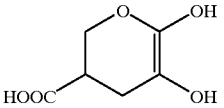

A developing agent can be incorporated in a layer of the photographic material, such as an emulsion layer, a protective layer, an interlayer or other light-insensitive layers, and preferably the emulsion layer, the interlayer which is farther from the support than the emulsion layer, and the protective layer. The developing agent to be incorporated is 0.01 to 10 mol, preferably 0.05 to 2 mol, and more preferably 0.1 to 1 mol per mol of silver halide of the emulsion layer.

The average particle size of a fluorescent substance of a fluorescent intensifying screen (hereinafter, denoted as intensifying screen) employed in the image forming process relating to the invention is preferably 7 $\mu$m or less, and more preferably 4 $\mu$m or less, in terms of reducing diffusion of light in the fluorescent substance layer which deteriorates sharpness. When the average particle size is too small, the sensitivity is markedly reduced. Accordingly, the average particle size is preferably o.3 mm or more, and more preferably 0.5 $\mu$m or more. Herein, the average particle size is a number average.

The ratio by weight of a binder to the fluorescent substance of intensifying screen used in the invention is 0.1 to 3.0% and dispersibility of the fluorescent substance in the binder is enhanced, so that the binder is uniformly present on the surface of the fluorescent substance and the fluorescent substance particles are brought so close together, leading to enhanced filling ratio. The ratio by weight of a binder to the fluorescent substance of intensifying screen used in the invention is 0.1 to 3.0%, the filling ratio is 68% or more and the layer thickness is 135 to 200 $\mu$m.

The fluorescent substance layer, in general, comprises fluorescent substance particles and binder and voids. The void is a space in which the fluorescent substance particles and binder is not substantially present. Accordingly, as the binder decreases, the voluminal void proportion increases. The void acts as a scattering factor of light, reducing diffusion of emission from the fluorescent substance and enhancing sharpness. When the weight ratio of the binder to the fluorescent substance exceeds 3.0%, voids in the layer decrease, reducing diffusion of emission and leading to deteriorated sharpness. When the weight ratio of the binder to the fluorescent substance is less than 0.1%, on the other hand, it becomes difficult for the binder to cover the overall surface of the fluorescent substance, function of the binder of binding the fluorescent substance together is hard to be displayed, and a high filling ratio can be achieved. Further, it becomes hard for the binder to be uniform over the whole layer, the fluorescent substance becoming hard to be homogeneously present, resulting in non-uniform emission and deteriorated image sharpness.

Preferred fluorescent substances used in the intensifying screen include tungstate fluorescent substances ($CaWO_4$, $MgWO_4$, $CaWO_4$:Pb); terbium-activated rare earth oxysulfide fluorescent substances [$Y_2O_2S$:Tb, $Gd_2O_2S$:Tb, $La_2O_2S$:Tb, (Y.Gd)2$O_2S$:Tb, (Y.Gd)$O_2S$:Tb.Tm3; terbium-activated rare earth phosphate fluorescent substances ($YPO_4$:Tb, $GdPO_4$:Tb, $LaPO_4$:Tb); terbium-activated rare earth oxyhalide fluorescent substances (LaOBr:Tb, LaOBr:Tb, Tm, LaOCl: Tb, Tm, GdOBr:Tb, GdOCl) and thulium-activated rare earth oxyhalide fluorescent substances (LaOBr:Tm, LaOCl:Tm); barium sulfate fluorescent substances [$BaSO_4$Pb, $BaSO_4$:$Eu^{2+}$, (Ba.Sr)$SO_4$:$Eu^{2+}$]; bivalent europium-activated alkali earth metal phosphate fluorescent substances [$(Ba_2PO_4)_2$:$Eu^{2+}$, $(Ba_2PO_4)_2$:$Eu^{2+}$]; bivalent europium-activated alakli earth metal fluorohalide fluorescent substances [BaFCl:$Eu^{2+}$, BaFBr:$Eu^{2+}$, BaFCl:$Eu^{2+}$.Tb, $BaF_2$. BaCl . KCl:$Eu^{2+}$(Ba.Mg)$F_2$. BaCl. KCl:$Eu^{2+}$]; iodide fluorescent substances [ZnS:Ag(Zn.Cd) S:Ag, (Zn.Cd)S:Cu, (Zn.Cd)S:Cu.Al]; hafnium phosphate fluorescent substances ($HfP_2O_7$:Cu); tantalate fluorescent substances ($YTaO_4$, YTaO4:Tm, $YTaO_4$:Nb, [Y,Sr] $TaO_4$:Nb, $GdTaO_4$:Tm, $GD_2O_3$. $Ta_2O_5$. $B_2O_5$:Tb].

It is preferred to fill the fluorescent substance in sloped grain structure to form the intensifying screen. Specifically, it is preferred that a fluorescent substance with a large particle size is coated in the surface protective layer-side and another fluorescent substance with smaller particle size is coated in the support-side. The small particle size is in the range of 0.5 to 2.0 $\mu$m and larger one is 10 to 30 $\mu$m.

As a binder, a thermoplastic elastomer whose softening temperature or a melting point is 30 to 150° C. is used singly or in combination with other binder polymers. The thermoplastic elastomer has elasticity at room temperature and has fluidity when heated. Therefore, it can prevent damage of the fluorescent substance due to pressure in compression. As examples of a thermo-plastic elastomer, polystyrene, polyolefin, polyurethane, polyester, polyamide, polybutadiene, ethylene vinyl acetate copolymer, poly vinyl chloride, natural rubbers, fluorine-containing rubbers, polyisoprene, chlorinated polyethylene, styrene-butadiene rubbers and silicone rubbers are cited. The component ratio of thermo-plastic elastomer in the binder is allowed to be 10 wt % or more and 100 wt % or less. However, it is desirable that the binder is composed of the thermo-plastic elastomer as much as possible, especially is composed of a thermoplastic elastomer of 100 wt %.

For producing the above-mentioned radiographic intensifying screen, it is preferable to produce it by a production method including 1) a step forming a fluorescent substance sheet composed of a binder and a fluorescent substance
2) a step providing the above-mentioned fluorescent substance sheet on a support and adhering the above-mentioned fluorescent substance sheet on the support while compressing at a softening temperature or melting point or more of the above-mentioned binder.

First of all, step 1) will be explained. The fluorescent substance sheet which is a fluorescent substance layer of a radiographic intensifying screen can be produced by coating a coating solution, wherein a fluorescent substance is dispersed uniformly in a binder solution, on a tentative support for forming the fluorescent substance sheet, drying and peeling it off from the tentative support. Namely, first of all, a binder and fluorescent substance particles are added to an appropriate organic solvent and then, stirred to prepare a coating solution wherein the fluorescent substance is dispersed uniformly in the binder solution.

As examples of a solvent for preparing a coating solution, lower alcohols such as methanol, ethanol, n-propanol and n-butanol; chlorine-containing hydrocarbons such as methylenechloride and ethylenechloride; ketones such as acetone, methylethylketone and methylisobutylketone; esters of lower fatty acids and lower alcohols such as methyl acetate, ethyl acetate and butyl acetate; ethers such as dioxane, ethyleneglycolmonoethylether and ethyleneglycolmonomethylether and their mixtures can be cited. The mixture ratio between the binder and the fluorescent substance in the coating solution varies depending upon the characteristic of the radiographic intensifying screen and the kind of fluorescent substance. Generally, the mixture ratio of the binder and the fluorescent substance is from 1:1 to 1:100 (by weight), and preferably from 1:8 to 1:40 (by weight).

Various additives such as a dispersant for improving dispersing property of a fluorescent substance in aforesaid coating solution and a plasticizer for improving binding force between a binder and a fluorescent substance in the fluorescent substance layer after being formed may be mixed. Examples of a dispersant used for the above-mentioned purpose include phthalic acid, stearic acid, caprolic acid and lipophilic surfactants may be cited. Examples of a plasticizer include phosphates such as triphenyl phosphate, tricresyl phosphate and diphenyl phosphate; phthalates such as diethyl phthalate and dimethoxyethyl phthalate; ester glycols such as ethylphthalylethyl glycolate and butylphthalylbutyl glycolate; and polyesters of polyethylene glycols and aliphatic dibasic acids such as polyester of triethylene glycol and adipic acid and polyester between diethylene glycol and succinic acid are cited. Next, the coating layer is formed by coating the coating solution containing the fluorescent substance and the binder prepared in the above-mentioned manner on the tentative support for forming a sheet uniformly. This coating operation can be conducted by the use of a conventional means such as a doctor blade method, a roll coater method and a knife coater method.

A material of the tentative support can be selected from glass, metal plate or conventional materials as a support for an intensifying screen of X-ray. Examples of such materials include plastic films such as cellulose acetate, polyester, polyethylene terephthalate, polyamide, polyimide, triacetate and polycarbonate, metallic sheets such as aluminium foil and aluminium alloy foil, an ordinary paper, baryta paper, resin-coated paper, pigment paper containing a pigment such as titanium dioxide, paper wherein polyvinyl alcohol is subjected to sizing, ceramic plates or sheets such as alumina, zirconia, magnesia and titania. A coating solution for forming the fluorescent substance layer is coated on the tentative support and dried. Following this, the coating layer is peeled off from the tentative support so that the fluorescent substance sheet which will be a fluorescent substance layer of a radiographic intensifying screen is formed. Therefore, it is desirable that a mold-releasing agent is coated on the surface of the tentative support and that the fluorescent substance sheet formed is easily peeled off from the tentative support.

Next, step 2) will be explained. First of all, a support for a fluorescent substance sheet prepared in the above-mentioned manner is prepared. This support can be selected arbitrarily from the same materials as those used for a tentative support used in forming the fluorescent substance sheet.

In a conventional radiographic intensifying screen, in order to strengthen binding between a support and a fluorescent substance layer and in order to improve sensitivity or image quality (sharpness and graininess) as the radiographic intensifying screen, it is known to coat a polymer substance such as gelatin as an adhesive layer on the surface of a support on the side of the fluorescent substance layer or to provide thereon a light-reflection layer comprising a light-reflective substance such as titanium dioxide or a light-absorption layer comprising a light-absorptive substance such as carbon black. The support used in the present invention may be provided with each of the above-mentioned layer. The constitution may be arbitrarily selected depending upon the purpose and application of the desired radiographic intensifying screen. The fluorescent substance sheet obtained through step a) is loaded on a support. Next, the fluorescent substance sheet is stuck on the support while compressing it at a softening temperature or a melting point or higher of the binder.

In the above-mentioned manner, by the use of a method that compress the fluorescent substance sheet without fixing it on the support in advance, the sheet can be spread thinly. Accordingly, it prevents damage of the fluorescent substance. In addition, compared to a case wherein the sheet is fixed for being pressed, a higher fluorescent substance filling rate can be obtained even with the same pressure. Examples of a compressor used for compressing processing of the present invention include conventional ones such as a calendar roll and a hot press. In compression processing by the use of the calendar roll, the fluorescent substance sheet obtained through step a) is loaded on the support, and then, the sheet is passed through rollers heated to the softening temperature or the melting point of the binder or higher at a certain speed. However, a compressor used for the present invention is not limited thereto. Any compressing means can be used, provided that it can compress the sheet while heating it. The compression pressure is preferably 50 kg/cm$^2$ or more.

In an ordinary radiographic intensifying screen, a transparent protective layer is provided for protecting the fluorescent substance layer physically and chemically on the surface of the fluorescent substance layer opposite to that being in contact with the support, as described before. Such a protective layer is preferably provided in the radiographic intensifying screen of the present invention. Layer thickness of the protective layer is ordinarily in a range from about 0.1 to 20 $\mu$m. The transparent protective layer can be formed by a method that coats a solution prepared by dissolving a transparent polymer such as cellulose derivatives including cellulose acetate and nitro cellulose; and a synthetic polymer including polymethyl methacrylate, polyvinyl butylal, polyvinyl formal, polycarbonate, polyvinyl acetate, vinyl chloride-vinyl acetate copolymer on the surface of the fluorescent substance layer. In addition, the transparent protective layer can also be formed by a method that forms a sheet for forming a protective layer such as a plastic sheet composed of polyethylene terephthalate, polyethylene naphthalate, polyethylene, polyvinylidene chloride or polyamide; and a protective layer forming sheet such as a transparent glass plate is formed separately and they are stuck on the surface of the fluorescent substance layer by the use of an appropriate adhesive agent.

As a protective layer used for the radiographic intensifying screen of the present invention, a layer formed by a coating layer containing an organic solvent soluble fluorescent resin is preferable. As a fluorescent resin, a polymer of a fluorine-containing olefin (fluoro olefin) or a copolymer of a fluorine-containing olefin is cited. A layer formed by a fluorine resin coating layer may be cross-linked. When a protective layer composed of a fluorine resin is provided, dirt exuded from a film in contacting with other materials and an X-ray film is difficult to come into inside of the protective layer. Therefore, it has an advantage that it is easy to remove dirt by wiping. When an organic solvent soluble fluorescent resin is used as a material for forming a protective layer, it can be formed easily by coating a solution prepared by dissolving this resin in a suitable solvent and drying it. Namely, the protective layer is formed by coating the protective layer forming material coating solution containing the organic solvent soluble fluorine resin on the surface of fluorescent layer uniformly by the use of the doctor blade and by drying it. This formation of a protective layer may be conducted concurrently with the formation of the fluorescent substance layer by the use of multilayer coating.

The fluorine resin is a homopolymer or copolymer of a fluorine containing olefin (fluoroolefin). Its examples include polytetrafluoroethylene, polychlorotrifluoroethylene, polyvinyl fluoride, polyvinylidene fluoride, tetrafluoroethylene-hexafluoropropylene copolymer and fluoroolefin-vinyl ether copolymer. Though fluorine resins are insoluble in an organic solvent, copolymers of fluoroolefins as a copolymer component are soluble in an organic solvent depending upon other constituting units (other than fluoroolefin) of the copolymers. Therefore, the protective layer can be formed easily by coating a solution wherein the aforesaid resin is dissolved in a suitable solvent for preparing on the fluorescent substance layer to be dried. Examples of the above-mentioned copolymers include fluoroolefin-vinyl ether copolymer. In addition, polytetrafluoroethylene and its denatured product are soluble in a suitable fluorine-containing organic solvent such as a perfluoro solvent. Therefore, they can form a protective layer in the same manner as in the copolymer containing the above-mentioned fluoroolefin as a copolymer component.

To the protective layer, resins other than the fluorine resin may be incorporated. A cross-linking agent, a hardener and an anti-yellowing agent may be incorporated. However, in order to attain the above-mentioned object sufficiently, the content of the fluorine resin in the protective layer is suitably 30 wt % or more, preferably 50 wt % or more and more preferably 70 wt % or more. Examples of resin incorporated in the protective layer other than the fluorine resin include a polyurethane resin, a polyacrylic resin, a cellulose derivative, polymethylmethacrylate, a polyester resin and an epoxy resin.

The protective layer for the radiographic intensifying screen used in the present invention may be formed by either of an oligomer containing a polysiloxane skeleton or an oligomer containing a perfluoroalkyl group or by both thereof. The oligomer containing the polysiloxane skeleton has, for example, a dimethyl polysiloxane skeleton. It is preferable to have at least one functional group (for example, a hydroxyl group). In addition, the molecular weight (weight average) is preferably in a range from 500 to 100000, more preferably 1000 to 100000, especially more preferably 3000 to 10000. In addition, the oligomer containing the perfluoroalkyl group (for example, a tetrafluoroethylene group) preferably contains at least one functional group (for example, a hydroxyl group: —OH) in a molecule. Its molecular weight (weight average) is 500 to 100000, more preferably 1000 to 100000 and especially preferably 10000 to 100000. When an oligomer containing a functional group is used, cross-linking reaction occurs between the oligomer and a resin for forming a protective layer in forming the protective layer so that the oligomer is taken into a molecule structure of the layer-forming resin. Therefore, even when the X-ray conversion panel is used for a long time repeatedly or cleaning operation of the surface of the protective layer is carried out, the oligomer is not taken off from the protective layer. Therefore, the addition of the oligomer becomes effective for a long time so that use of the oligomer having a functional group becomes advantageous. The oligomer is contained in the protective layer preferably in an amount of 0.01 to 10 wt % and especially 0.1 to 2 wt %.

In the protective layer, perfluoro olefin resin powder or silicone resin powder may be added. As the perfluoro olefin resin powder or the silicone resin powder, those having an average particle size of preferably 0.1 to 10 $\mu$m, and more preferably 0.3 to 5 $\mu$m. The above-mentioned perfluoro olefin resin powder or the silicone resin powder is added to the protective layer preferably in an amount of 0.5 to 30 wt % and more preferably 2 to 20 wt % and especially preferably 5 to 15 wt%.

The protective layer of the intensifying screen is preferably a transparent synthetic resin layer coated on the fluorescent substance layer and having a thickness of 5 $\mu$m or less. The use of a thick protective layer leads to shorten the distance between the intensifying screen and a silver halide emulsion and therefore enhance sharpness of the resulting X-ray photographic image.

The intensifying screen used in the present invention is prepared in accordance with the method described in JP-A 6-75097. The fluorescent substance is coated by the multilayer coating method so that larger particles are arranged near the surface protective layer.

EXAMPLES

Embodiments of the present invention will be further explained based on examples, but the present invention are by no means limited to these examples.

Example 1

Preparation of Emulsion

To a vessel containing water of 1 liter of water, potassium bromide of 6 g and gelatin of 7 g and maintained at 55° C. were with stirring by the double jet method for 37 sec. an aqueous silver nitrate solution of 37 cc (silver nitrate of 4 g) and an aqueous potassium bromide solution of 38 cc (potassium bromide of 5.9 g). Then, gelatin of 18.6 g was added with raising the temperature to 70° C. and thereafter, the pBr was adjusted to 2.3 with a silver nitrate aqueous solution. A 25% aqueous ammonia solution of 7 cc was added thereto and after physical-ripening for 10 min., a 100% acetic solution of 6.5 cc was added. Subsequently, an aqueous solution of 18 g silver nitrate and an aqueous solution of potassium bromide were added with maintaining the pBr by the controlled double jet method in 35 min. When the grain growth reached a portion as shown in Table 1 with respect to the final grains, fine silver iodide grains were added. Herein, the final grains means those at the time when the grain growth is completed. In Emulsion 6 in Table 1, for example, fine silver iodide grains were added at the time when silver halide grains were grown to 95%, in size, of the final grain. After allowing grains to grow to the intended grain size, physical ripening continued further for 5 min. at the same temperature and the emulsion was washed by the coagulation process to remove soluble salts. The emulsion was raised to a temperature of 40° C., 30 g gelatin and 2.4 g pheoxyethanol were added thereto, the ph was adjusted to 5.90 with sodium hydroxide and the pAg was adjusted to 8.21 with an aqueoussilver nitrate solution or an aqueous potassium bromide solution. Characteristics of silver halide grains of emulsions Em-1 to 16 are shown in Table 1. In the Table, the iodide content of the outermost layer of the grain were measure by the TOF-SIMs method afore-described.

The resulting emulsion was chemically sensitized with stirring while maintained at 56° C. Thus, A sensitizing dye (A) of 460 mg/Ag mol was added in the form of a solid particle dispersion, prepared as described below; then, chemical ripening was optimally conducted by adding ammonium thicyanate of $7.0\times10^{-4}$ mol/Ag mol, potassium chloroaurate, sodium thiosulfate, triphenylphosphine selenide of $3.0\times10^{-6}$ mol/Ag mol and a compound as shown in Table 1; a fine silver iodide grain emulsion of 3×10–3 mol/Ag mol was added; and 4-hydroxy-6-methyl-1,3,3a,7-tetraazaindene (TAI) of $3\times10^{-2}$ mol/Ag mol was added to stabilize the emulsion. Thus prepared emulsion No. 1 was shown in Table 1 with respect to its characteristics including the grain for, the surface halide composition and its distribution among grains. Similarly, emulsions No. 2 to 16 were prepared ¥, as shown in Table 1.

Preparation of Solid Particle Dispersion of Sensitizing Dye

Sensitizing dyes (A) and (B) were added in a ratio of 100:1 to water maintained at 27° C. and stirred by a high-speed dissolver at 3,500 rpm for a period of 30 to 120 min. to obtain a solid particle dispersion of the sensitizing dyes. In this case, the dispersion was so adjusted that the concentration of Dye (A) was 2%.

Sensitizing Dye (A): 5,5'-Dichloro-9-ethyl-3,3'-di-(3-sulfopropyl)oxacarbocyanine anhydride Sensitizing Dye (B): 5,5'-Di-(butoxycarbonyl)-1,1'-diethyl-3,3'-di-(4-sulfobutyl) benzimidazolocarbocyanine

Preparation of Fine Silver Iodide Grains

| | | |
|---|---|---|
| A1 | | |
| | Ossein gelatin | 100 g |
| | KI | 8.5 g |
| | Distilled water to make | 2,000 ml |
| B1 | | |
| | AgNO3 | 360 g |
| | Distilled water to make | 605 ml |
| C1 | | |
| | KI | 352 g |
| | Distilled water to make | 605 ml |

To a reaction vessel was added solution A1, and solutions B1 and C1 were added by the double jet method at a constant flow rate for 30 min., while the pAg was maintained at 13.5. The resulting silver iodide emulsion (denoted as fine silver iodide grain emulsion) was a mixture of β-AgI and γ-AgI with an average grain size of 0.06 μm.

TABLE 1

| Emul- | AgI Fine grain | | Av. dia- | | Av. | Projected | Surface halide content | | S-compound | | |
|---|---|---|---|---|---|---|---|---|---|---|---|
| sion No. | Add. time (%) | Amount (mol/Ag mol) | meter[a] (μm) | V.C.[b] (%) | aspect ratio | area[c] (%) | AgI (mol %) | V.C.[d] (%) | Compd. | Amount (mol/Ag mol) | Remark |
| 1 | — | — | 0.90 | 21 | 4.5 | 98 | — | — | — | — | Comp. |
| 2 | — | — | 0.90 | 21 | 4.5 | 98 | — | — | 1-15 | $1.5\times10^{-3}$ | Comp. |
| 3 | 100 | 0.4 | 0.90 | 21 | 4.5 | 98 | 2.8 | 25 | — | — | Comp. |
| 4 | 100 | 0.4 | 0.90 | 21 | 4.5 | 98 | 2.8 | 25 | 1-15 | $1.5\times10^{-3}$ | Comp. |
| 5 | 100 | 0.4 | 0.90 | 21 | 4.5 | 98 | 2.8 | 25 | 2-10 | $1.5\times10^{-3}$ | Comp. |
| 6 | 95 | 0.4 | 0.90 | 21 | 4.5 | 98 | 2.5 | 12 | — | — | Comp. |
| 7 | 95 | 0.4 | 0.90 | 21 | 4.5 | 98 | 2.5 | 12 | 1-15 | $1.5\times10^{-3}$ | Inv. |
| 8 | 95 | 0.4 | 0.90 | 21 | 4.5 | 98 | 2.5 | 12 | 2-10 | $1.5\times10^{-3}$ | Inv. |
| 9 | 70 | 0.4 | 0.90 | 21 | 4.5 | 98 | 1.5 | 12 | — | — | Comp. |
| 10 | 70 | 0.4 | 0.90 | 21 | 4.5 | 98 | 1.5 | 12 | 1-15 | $1.5\times10^{-3}$ | Inv. |
| 11 | 70 | 0.4 | 0.90 | 21 | 4.5 | 98 | 1.5 | 12 | 1-15 | $1.5\times10^{-2}$ | Inv. |
| 12 | 70 | 0.4 | 0.90 | 21 | 4.5 | 98 | 1.5 | 12 | 2-10 | $1.5\times10^{-3}$ | Inv. |
| 13 | 100 | 0.7 | 0.90 | 21 | 4.5 | 98 | 3.4 | 25 | 1-15 | $1.5\times10^{-3}$ | Comp. |
| 14 | 95 | 0.7 | 0.90 | 21 | 4.5 | 98 | 2.7 | 14 | — | — | Comp. |
| 15 | 95 | 0.7 | 0.90 | 21 | 4.5 | 98 | 2.7 | 14 | 1-15 | $1.5\times10^{-3}$ | Inv. |
| 16 | 95 | 0.7 | 0.90 | 21 | 4.5 | 98 | 2.7 | 14 | 2-10 | $1.5\times10^{-3}$ | Inv. |

a: Equivalent circle diameter
b: Variation coefficient of grain diameter
c: Percentage of the projected area accounted for by tabular grains having an aspect ratio of 3 to 15
d: Variation coefficient of distribution among grains

Preparation of Coating Sample

Synthesis of Colloidal Tin Oxide Dispersion:

Stannic chloride hydrate of 65 g was dissolved in a 2000 cc aqueous solution to obtain a solution. Subsequently, the solution was boiled to obtain co-precipitates. The resulting precipitates were washed several times with distilled water by decantation. After confirming no reaction with chloride ions by adding dropwise silver nitrate to the distilled water used for washing, the precipitate was added to water of 1000 cc and dispersed, than, the total amount was made to 2000 cc. Further, 40 cc of aqueous ammonia was added thereto and the mixture solution was heated to obtain a colloidal gel dispersion. The sol dispersion was concentrated to 8% concentrate with blowing ammonia Thus prepared tin oxide sol was proved to have a specific volume resistance of $3.4\times10^4$ Ωcm.

Preparation of Subbed Support:

On both sides of a blue-tinted polyethylen terephthalate film base for use in a X-ray film with a density of 0.170 and a thickness of 175 μm, which were subjected to corona discharge treatment at 0.5 kV·A·min./$m^2$, a latex solution for subcoat (L-2), as described below was coated so as to have a dry thickness of 0.2 μm and then L-1 as below was coated so as to have a dry thickness of 0.053 μm, and dried at 123° C. for 2 min.

(L-1)

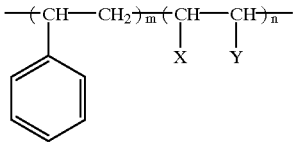

m;n=1:1 (molar ratio)

X: COOH or COONa

Y: COONa or $COOCH_2CF_2CF_2H$
(COONa:$COOCH_2CF_2CF_2H$=9:1 molar ratio)
Solid component 6% aqueous solution (L-2):

A latex solution (solid component, 30%) of a copolymer comprised of n-butylacrylate (10 wt. %), t-butylacrylate (35 wt. %), styrene (27 wt. %) and 2-hydroxyethylacrylate (28 wt. %).

On one side of the film base was provided the same sublayer as Support 1 and on the other side, a mixture of tin oxide ($SnO_2$) sol prepared in Synthesis Example 1, afore-described L-2 and L-1 in a ratio by volume of 35:15:50 was coated so as to have a dry thickness of 0.12 μm and a coating amount of the sol component of 250 mg/$M^2$, and further thereon a mixture of L-1 and L-3 in a ratio by volume of 70:30 was coated so as to have a dry thickness of 0.053 μm, being dried at 120° C. for 1 min. The base film was previously subjected to corona discharge treatment at 0.5 kV. A. min./$m^2$. The thus prepared support was referred to as Support 2.

(L-3):

A mixture of 34.02 weight parts of dimethyl terephthalate, 25.52 weight parts of dimethyl isophthalate, 12.97 weight parts of dimethyl 5-sulfoisophthalate sodium salt, 47.85 weight parts of ethylene glycol, 18.95 weight parts of 1,4-cyclohexanedimethanol, 0.065 weight parts of calcium acetate monohydrate and 0.022 weight parts of manganese acetate was subjected to ester exchange reaction at 170 to 220° C. under nitrogen gas, while methanol was distilled away. Thereafter, 0.04 weight parts of trimethyl phosphate, 0.04 weight parts of antimonyl trioxide as a polycondensation catalyst and 15.08 weight parts of 1,4-dicyclohexane-dicarboxylic acid were added, and a theoretical amount of water was almost distilled away at a reaction temperature of 220 to 235° C. to complete esterification. Further, the reaction system was evacuated with heating by taking one hour and polycondensation was carried out at 280° C. and 1 mm Hg or less over a period of one hour to obtain polyester product (intrinsic viscosity of 0.35).

To 7300 g of an aqueous solution of the thus prepared polyester polymer, 30 g of styrene, 30 g of butyl methaacrylate, 20 g of glycidyl methaacrylate, 20 g of acrylamide and 1.0 g of ammonium persulfate were added to be reacted at 80° C. over a period of 5 hr. The reaction product was cooled down to a room temperature and adjusted so as to have a solid component of 10 wt. %. A coating solution was thus-prepared.

(L-4):

A latex solution of a copolymer comprised of n-butylacrylate (40 wt. %), styrene (20 wt. %) and glycidyl methaacrylate (40 wt. %).

Further to the subbed support, a complex latex, which was added to mulsion and protective layers, was prepared as follows.

Synthesis of Complex Latex

To a 1,000 ml four-necked flask provided with a stirrer, a thermometer, a dropping funnel, nitrogen introducing tube and reflax condenser were added with introducing nitrogen gas to deoxigenate 360 cc of distilled water and 126 g of a 30 wt. % colloidal silica dispersion, and the mixture was heated until reached the internal temperature of 80° C. The following surfactant of 1.3 g and ammonium persulfate as an initiator of 0.023 g were added, then vinyl pivalic acid of 12.6 g was added and the reaction was continued for 4 hrs. Thereafter, the pH was adjusted to 6 with a cooled aqueous sodium hydroxide solution to obtain a complex latex. Lx-1.

Surfactant

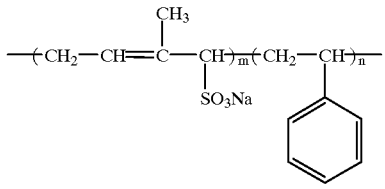

m:n = 1:1

The above latex was comprised of an inorganic compound and hydrophobic latex in a ratio of 4:1.

Preparation of Photographic Material

On both sides of subbed Support, coating solutions of a cross-over light shielding layer, emulsion layer and protective layer were simultaneously coated so as to have the following amount, and dried.

| | |
|---|---|
| First layer (Cross-over light shielding layer) | |
| Gelatin | 0.2 g/2 |
| Solid particle dispersion of dye (AH) | 20 mg/m$^2$ |
| Sodium dodecylbenzenesulfonate | 5 mg/m$^2$ |
| Compound (I) | 5 mg/m$^2$ |
| 2,4-Dichloro-6-hydroxy-1,3,5-triazine sodium salt | 5 mg/m$^2$ |
| Colloidal silica (av.size 0.014 $\mu$m) | 10 mg/m$^2$ |
| Second layer (Emulsion layer) | |
| The following additives were added to the emulsion above-described. | |
| Gelatin (including that of Emulsion) | 1.2 mg/m$^2$ |
| Compound (G) | 0.5 mg/m$^2$ |
| 2,6-Bis(hydroxyamino)-4-diethylamino-1,3,5-triazine | 5 mg/m$^2$ |
| t-Butyl-catechol | 5 mg/m$^2$ |
| Polyvinyl pyrrolidone (M.W. 10,000) | 20 mg/m$^2$ |
| Styrene-anhydrous maleic acid copolymer | 80 mg/m$^2$ |
| Sodium polystyrenesulfonate | 80 mg/m$^2$ |
| Trimethylolpropne | 350 mg/m$^2$ |
| Diethylene glycol | 50 mg/m$^2$ |
| Nitrophenyl-triphenyl-phosphonium chloride | 1 mg/m$^2$ |
| Ammonium 1,3-dihydroxybenzene-4-sulfonate | 50 mg/m$^2$ |
| Sodium 2-mercaptobenzimidazole-5-sulfonate | 5 mg/m$^2$ |
| Compound (H) | 0.5 mg/m$^2$ |
| n-$C_4H_9OCH_2CH(OH)CH_2N(CH_2COOH)_2$ | 20 mg/m$^2$ |
| Compound (M) | 5 mg/m$^2$ |
| Compound (N) | 5 mg/m$^2$ |
| Colloidal silica | 0.5 mg/m$^2$ |
| Compound (P) | 0.2 mg/m$^2$ |
| Compound (Q) | 0.2 mg/m$^2$ |
| Hydrophobic latex Lx-1 | 1.2 g/m$^2$ |
| | Latex content 0.3 g/m$^{2)}$ |
| Water soluble Polymer (dextran with molecular weight of 50,000) | 0.3 g/m$^2$ |
| Leuco dye (R) | $2 \times 10^{-3}$ mol/Ag mol |
| Third layer (Lower protective layer) | |
| Gelatin | 0.3 g/m$^2$ |
| Dioctyl phthalate | 0.2 g/m$^2$ |
| Forth layer (Upper protective layer) | |
| Gelatin | 0.3 g/m$^2$ |
| Matting agent of polymethyl methaacrylate (area-averaged particle size 7.0 $\mu$m) | 27 mg/m$^2$ |
| Formaldehyde | 20 mg/m$^2$ |
| 2,4-Dichloro-6-hydroxy-1,3,5-triazine sodium salt | 10 mg/m$^2$ |
| Polysiloxan (SI) | 50 mg/m$^2$ |
| Compound (I) | 30 mg/m$^2$ |
| Compound (S-1) | 7 mg/m$^2$ |
| Compound (K) | 15 mg/m$^2$ |
| Compound (B) | 2 mg/m$^2$ |
| Compound (J) | 2 mg/m$^2$ |
| Compound (O) | 50 mg/m$^2$ |
| Compound (S-2) | 5 mg/m$^2$ |

The coating described above is per one size of the support. and the coating amount was adjusted so as to have the silver coating amount of 1.5 g per m$^2$ of one side pf the support. Using emulsions No. 1 through 16, Samples 1 to 16 were prepared. Chemical structure of the compounds contained in he first layer (cross-over light shielding layer), second layer (emulsion layer) and fourth layer (upper protective layer) is shown below.

Dye (AH) in the form of solid particle dispersion

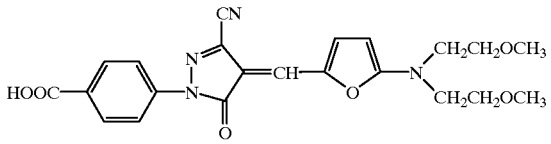

-continued

Compound (I)

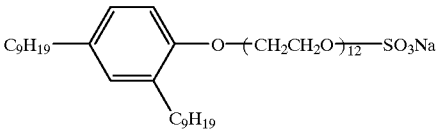

Compound (G)

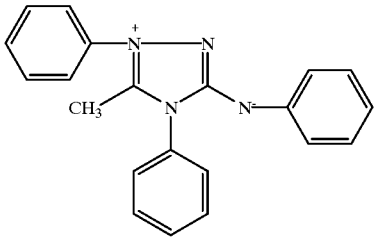

Compound (H)

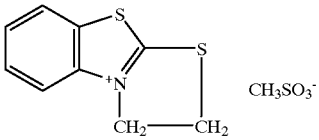

Compound (M)

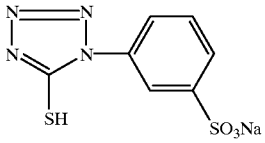

Compound (N)

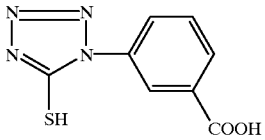

Compound (P)

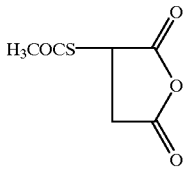

Compound (Q)

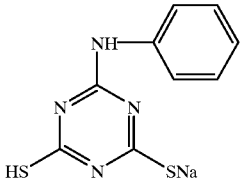

Compound (S-1)

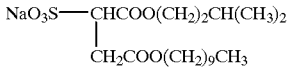

-continued

Compound (K)

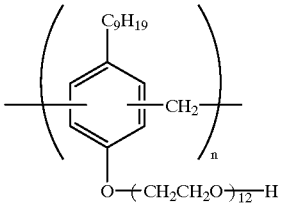

Mixture of n = 2 - 5

Hardener (B)

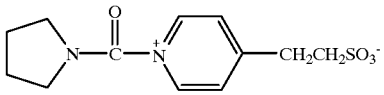

Polysiloxane (SI)

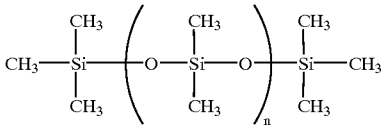

n≈~1000

Compound (J)

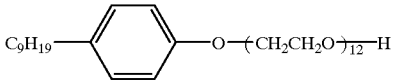

Compound (O)

$C_{11}H_{23}CONH(CH_2CH_2O)_5H$

Compound (S-2)

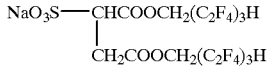

Leuco Dye (R)

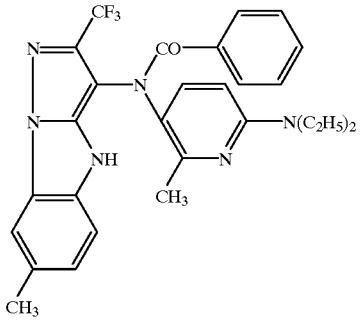

Preparation of Radiographic Intensifying Screen 1

Fluorescent substance $Gd_2O_2S$:Tb (average particle size, 1.8 μm) 200 g

Polyurethane type thermoplastic elastomer

Deluxe TPKL-5-2625, solid component of 40% (product by Sumitomo Bayer Corp.) 20 g Nitrocellulose (nitration degree of 11.5%) 2 g To the above was added methylethylketone as a solvent and the mixture was dispersed with a propeller type mixer to obtain a coating solution for fluorescent substance forming layer with a viscosity of 25 ps at 25° C. (Binder/Fluorescent substance=1/22).

Separately, 90 g of soft type acryl resin, 50 g of nitrocellulose were added to methylethylketone to be dispersed to obtain a dispersion with a viscosity of 3 to 6 ps at 25° C., as a coating solution to form a sublayer.

A polyethylene terephthalate base (support) compounded with titanium dioxide and with a thickness of 250 μm was horizontally placed on a glass plate and thereon was uniformly coated the coating solution of the sublayer above-described by using a doctor blade. Thereafter, the coated layer was dried with slowly increasing a temperature from 25 to 100° C. to form the sublayer on the support. A thickness of the sublayer was 15 μm.

Further thereon was coated the coating solution of the fluorescent substance in a thickness of 240 μm by using a doctor blade and dried, and subjected to compression. The compression was conducted by means of a calendar roll at a pressure of 800 kgw/cm$^2$ and a temperature of 80° C. After compression, a transparent protective layer was formed in accordance with the method described in Example 1 of JP-A 6-75097. There was thus prepared radiographic intensifying screen 1 comprising a support, sublayer, fluorescent substance layer and transparent protective layer.

Preparation of Radiographic Intensifying Screen 2

A radiographic intensifying screen 2 comprising a support, sublayer, fluorescent substance layer and transparent protective layer in the same manner as the intensifying screen 1, except that a coating solution of the fluorescent substance layer was coated in a thickness of 150 μm and the compression was not conducted.

Measurement of Characteristics of the Intensifying Screen (1) Sensitivity measurement:

A one-sided photographic material MRE, product by Eastman Kodak in contact with an objective intensifying screen was exposed to X-ray through a step wedge having a width of log E=0.15, with varying exposure by distance. Exposed photographic material were processed according to the method which will be described in measurement of characteristics of the photographic material.

Densitometry of the processed samples were made with visible light to obtain a characteristic curve. A sensitivity is expressed as a relative value of a reciprocal of X-ray exposure necessary for obtaining a density of Dmin plus 1.0, based on the sensitivity at the time when using intensifying screen 1 being 100 (standard value)

(source) Measurement of X-ray Absorbed Amount

The X-ray which is produced from a tungsten target tube at 80 kVp by three phase power supply is allowed to transmit through an aluminum plate with a thickness of 3 mm and reach an intensifying screen fixed at the position of 200 cm farther from the tungsten anode of the target tube. Subsequently, the amount of X-ray which is transmitted through the intensifying screen is measure at the position of 50 cm behind the screen by a ionization dosimeter.

The X-ray absorbed amount of each intensifying screen is shown in Table 2.

TABLE 2

| Screen No. | X-ray absorbed amount (%) | Phosphor filling ratio (%) | Phosphor layer thickness (μm) | Sensitivity |
|---|---|---|---|---|
| 1 | 55 | 72 | 154 | 100 |
| 2 | 37 | 65 | 105 | 61 |

Processing-1: Processing by the Use of a Solid Processing Composition Containing Hydroquinone Solid processing compositions for use in replenishing developer were prepared according to the following operations (A) and (B).

Operation (A)

3000 g of hydroquinone, as a developing agent was ground into grain until an average grain size became 10 μm using a commercially available bandom mill. 3000 g of sodium sulfite, 200 g of potassium sulfite and 1000 g of Dimezone were added to this powder and mixed by the mill for 30 min. After granulating the mixture by adding 30 ml of water at room temperature for 10 min., the granulated product was dried for 2 hr. using a fluidized bed dryer at 40° C. to remove moisture contained almost completely. The thus prepared granules was mixed with 100 g of polyethylene glycol 6000 using a mixer for 10 min. in a room conditioned at 25° C. and 40% R.H. Thereafter, the mixture was subjected to compression-molding on a modified tabletting machine, Tough Press Collect 1527 HU, produced by Kikusui Manufacturing Co., Ltd. to prepare 2500 tablets (A) having a weight of 3.84 g per tablet, for use as developer-replenisher.

Operation (B)

100 g of DTPA, 4000 g of potassium carbonate, 10 g of 5-methylbenzotriazole, 7 g of 1-phenyl-5-mercaptotetrazole, 5 g of 2-mercaptohypoxanthine, 200 g of KOH and N-acetyl-D,L-penicillamine were ground to form granules in a similar manner to the operation (A). After granulation, the granules were dried at 50° C. for 30 min. to almost completely remove moisture contained. Thereafter, the mixture was subjected to compression-molding on a modified tabletting machine, Tough Press Collect 1527 HU, produced by Kikusui Manufacturing Co., Ltd. to prepare 2500 tablets (B) having a weight of 1.73 g per tablet, for use as developer-replenisher.

Tablets for use in fixer-replenishment were prepared according to the following operations.

Operation (C)

14000 g of a mixture of ammonium thiosulfate/sodium thiosulfate (70/30 by weight) and 1500 g of sodium sulfite were ground and mixed using commercially available mixing machine. Adding water of 500 ml, the mixture was granulated in a similar manner to the operation (A). After granulation, the granules were dried at 60° C. for 30 min. to almost completely remove moisture contained. Thereafter, 4 g of N-lauroylalanine was added thereto and the mixture was subjected to compression-molding on a modified tabletting machine, Tough Press Collect 1527 HU, produced by Kikusui Manufacturing Co., Ltd. to prepare 2500 tablets (A) having a weight of 6.202 g per tablet, for use as fixed-replenisher.

Operation (D)

1000 g of boric acid, 1500 g of aluminum sulfate 18 hydrate, 3000 g of sodium hydrogen acetate (equimolar mixture of glacial acetic acid and sodium acetate) and 200 g of tartaric acid were ground and mixed in a similar manner to the above operation (A). Adding water of 100 ml, the mixture was granulated in a similar manner to the operation (A). After granulation, the granules were dried at 50° C. for 30 min. to almost completely remove moisture contained. Thereafter, 4 g of N-lauroylalanine was added thereto and the mixture was subjected to compression-molding on a modified tabletting machine, Tough Press Collect 1527 HU, produced by Kikusui Manufacturing Co., Ltd. to prepare 1250 tablets (B) having a weight of 4.562 g per tablet, for use as fixed-replenisher.

| Starter: | |
|---|---|
| Glacial acetic acid | 2.98 g |
| KBr | 4.0 g |
| Water to make | 1 liter |

At the start of processing, tablets for developer were dissolved in water to prepare a developer and 330 ml of the starter was added to 16.5 l of the developer to prepare a starting developer solution. The start solution was introduced in a developer bath and processing was started. The pH of the developer solution was 10.45.

Photographic materials prepared in Example 1 were exposed so as to give a density of 1.0 and subjected to running-processing. Processing was carried out using an automatic processor, SRX-502, which was provided with a input member of a solid processing composition and modified so as to complete processing in 15 sec. During running-processing, to the developer solution were added tablets (A) and (B), each 2 tablets and 76 ml of water per 0.62 $m^2$ of the photographic material. When each of the tablets (A) and (B) was dissolved in water of 38 ml, the pH was 10.70. To the fixer solution were added 2 tablets of (C) and 1 tablet of (D) per 0.62 $m^2$ with 74 ml of water. Addition of water was started at the same time of that of the tablets and continued at a constant rate further for 10 min. in proportion to a dissolving rate of the solid processing composition.

| Processing condition: | |
|---|---|
| Developing time: | 4 sec. |
| Fixing time: | 3.1 sec. |
| Washing time: | 2 sec. |
| between washing and drying (squeegee): | 1.6 sec. |
| Drying time: | 4.3 sec. |
| Total processing time: | 15 sec. |

Processing-2: Processing by the Use of a Solid Processing Composition not Containing Hydroquinone Solid processing compositions for use in replenishing developer were prepared according to the following operations (E) and (F).

Operation (E)

13000 g of sodium erythorbic acid, as a developing agent was ground into grain until an average grain size became 10 μm using a commercially available bandom mill. 4877 g of sodium sulfite, 975 g of phenidone and 1635 g of DTPA were added to this powder and mixed by the mill for 30 min. After granulating the mixture by adding 30 ml of water at room temperature for 10 min., the granulated product was dried for 2 hr. using a fluidized bed dryer at 40° C. to remove moisture contained almost completely. The thus prepared granules was mixed with 2167 g of polyethylene glycol 6000 using a mixer for 10 min. in a room conditioned at 25° C. and 40% R.H. Thereafter, the mixture was subjected to compression-molding on a modified tabletting machine, Tough Press Collect 1527 HU, produced by Kikusui Manufacturing Co., Ltd. to prepare 2500 tablets (A) having a weight of 8.715 g per tablet, for use as developer-replenisher.

Operation (F)

19500 g of potassium carbonate, 8.15 g of 1-phenyl-5-mercaptotetrazole 3.25 g of sodium hydrogen carbonate, 650 g of glutar aldehyde sulfite adduct and 1354 g of polyethylene glycol 6000 were ground to form granules in a similar manner to the operation (E). After granulation, the granules were dried at 50° C. for 30 min. to almost completely remove moisture contained. Thereafter, the mixture was subjected to compression-molding on a modified tabletting machine, Tough Press Collect 1527 HU, produced by Kikusui Manufacturing Co., Ltd. to prepare 2500 tablets (F) having a weight of 9.90 g per tablet, for use as developer-replenisher.

Tablets for fixer were prepared according to the following operations.

Operation (G)

18560 g of a mixture of ammonium thiosulfate, 1392 g of sodium thiosulfate, 580 g of sodium hydroxide and 2.32 g of disodium ethylenediaminetetraacetate were ground and mixed using commercially available mixing machine. Adding water of 500 ml, the mixture was granulated in a similar manner to the operation (A). After granulation, the granules were dried at 60° C. for 30 min. to almost completely remove moisture contained. The resulting granules were subjected to compression-molding on a modified tabletting machine, Tough Press Collect 1527 HU, produced by Kikusui Manufacturing Co., Ltd. to prepare 2500 tablets (G) having a weight of 8.214 g per tablet, for use as fixed-replenisher.

Operation (H)

1860 g of boric acid, 6500 g of aluminum sulfate 18 hydrate, 1860 g of glacial acetic acid and 928 g of sulfuric acid (50 wt %) were ground and mixed in a similar manner to the above operation (A). Adding water of 100 ml, the mixture was granulated in a similar manner to the operation (A). After granulation, the granules were dried at 50° C. for 30 min. to almost completely remove moisture contained. The resulting granulates were subjected to compression-molding on a modified tabletting machine, Tough Press Collect 1527 HU, produced by Kikusui Manufacturing Co., Ltd. to prepare 1250 tablets (H) having a weight of 4.459 g per tablet, for use as fixed-replenisher.

| Starter: | |
|---|---|
| Glacial acetic acid | 210 g |
| KBr | 350 g |
| Water to make | 1 liter |

At the start of processing, tablets for developer were dissolved in water to prepare a developer and 330 ml of the starter was added to 16.5 l of the developer to prepare a starting developer solution. The start solution was introduced in a developer bath and processing was started. The pH of the developer solution was 10.45.

Photographic materials prepared in Example 1 were exposed so as to give a density of 1.0 and subjected to running-processing. Processing was carried out using an automatic processor, SRX-502, which was provided with a input member of a solid processing composition and modified so as to complete processing in 15 sec. During running-processing, to the developer solution were added one tablets of (E), two tablets of (F) and 20 ml of water per 0.62 $m^2$ of the photographic material. When each of the tablets (A) and (B) was dissolved in water of 20 ml, the pH was 10.70. To the fixer solution were added 4 tablets of (G) and 2 tablet of (H) per 1.00 $m^2$ with 50 ml of water. Addition of water was started at the same time of that of the tablets and continued at a constant rate further for 10 min. in proportion to a dissolving rate of the solid processing composition.

| Processing condition: | |
|---|---|
| Developing time: | 4 sec. |
| Fixing time: | 3.1 sec. |
| Washing time: | 2 sec. |
| between washing and drying (sgueegee): | 1.6 sec. |
| Drying time: | 4.3 sec. |
| Total processing time: | 15 sec. |

Processing-3: Processing by the Use of a Solid Processing Composition not Containing Hydroquinone and Containing a Compound Represented by Formula (3)

Solid processing compositions for use in replenishing developer were prepared in a manner similar to Processing-2, except that sodium erythorbate used in processing-2 was replaced by an eqimolar amount of exemplified Compound 3-1 of formula (3).

Sensitometry Evaluation:

Photographic material samples were allowed to stand at room temperature over a period of 3 days. Separately, Samples were subjected to forced aging test. Thus, samples were also allowed to stand at a temperature of 50° C. and a relative humidity of 80% over a period of 3 days. Thereafter, each sample is sandwiched between the intensifying screens (1 or 2), exposed to X-ray through a penetrometer type B (product by Konica Medical), and processed with SRX-503 automatic processor, which was provided with a input member of a solid processing composition, according to the replenishing rate and the processing time described above. A sensitivity was defined as a reciprocal of X-ray exposure necessary for giving a density of minimum density plus 1.0. The sensitivity was expressed as a relative vale, based on the sensitivity of sample 1 being 100, when sandwiched with Screen-1.

Photographic material samples were exposed so as to give a density of 1.0 and subjected to running-processing. During running-processing, two tablet (A) and two tablet (B) per 0.62 $m^2$ of the photographic material were supplied to the developing solution, with 76 ml of water. When one tablet of each (A) and (B) were dissolver in water of 38 ml, its pH was 10.70. To the fixing solution, two tablets of (C) and one tablet of (D) were added with 74 ml of water. Addition of water was started at the same time of that of the tablets and continued at a constant rate further for 10 min. in proportion to a dissolving rate of the solid processing composition.

Evaluation of Covering Power:

Each sample was subjected to exposure giving the maximum density and processed in a manner similar to the sensitometric evaluation. Processed samples each were subjected to fluorescent X-ray analysis to determine the silver amount ($g/m^2$). Covering power was determined according to the following equation:

$$\text{Covering Power (CP)} = (\text{Maximum Density}/\text{Silver Amount}) \times 100.$$

Evaluation of Pressure Resistance

Under humidifying conditions at 50% R.H., one end of the photographic material sample was fixed and bent along a stainless pipe with 8 mm diameter at a bending rate of 360°/sec and with rotating 180°. After processing, an increased fog density at bent portions was measured.

Evaluation of Silver Image Color

Photographicmaterial samples, each with a size of 10 cmx 30 cm was exposed with sandwiching between intensifying screens-1 and processed in a manner similar to sensitometry evaluation. Precessed samples were visually evaluated, based on the following criteria:

5: No yellowish color and neutrak black

4: Very slightly yellowish color

3: Yellowish color but acceptable level in practical use

2: Strongly yellowish color and problem in practical use

1: Markedly yellowish color and non-acceptable in practical use.

Results are shown in Tables 3 and 4.

TABLE 3

| Sample No. | Emulsion No. | Intensifying screen 1 | | | | | | | | | | | | | |
|---|---|---|---|---|---|---|---|---|---|---|---|---|---|---|---|
| | | Processing-1 | | | | | Processing-2 | | | | Processing-3 | | | | |
| | | Fog | S | CP | PR | SIC | Fog | S | CP | SIC | Fog | S | CP | SIC | Remark |
| 1 | 1 | 0.05 | 100 | 55 | 0.32 | 2 | 0.05 | 85 | 50 | 1 | 0.05 | 88 | 50 | 1 | Comp. |
| 2 | 2 | 0.05 | 100 | 55 | 0.35 | 2 | 0.05 | 85 | 50 | 1 | 0.05 | 88 | 50 | 1 | Comp. |
| 3 | 3 | 0.05 | 115 | 50 | 0.36 | 1 | 0.05 | 100 | 43 | 1 | 0.05 | 102 | 45 | 1 | Comp. |
| 4 | 4 | 0.06 | 120 | 56 | 0.35 | 1 | 0.05 | 105 | 52 | 1 | 0.06 | 106 | 55 | 1 | Comp. |
| 5 | 5 | 0.05 | 120 | 57 | 0.36 | 1 | 0.05 | 105 | 51 | 1 | 0.05 | 106 | 54 | 1 | Comp. |
| 6 | 6 | 0.04 | 125 | 59 | 0.35 | 3 | 0.04 | 106 | 51 | 2 | 0.05 | 109 | 54 | 1 | Comp. |
| 7 | 7 | 0.01 | 164 | 68 | 0.05 | 5 | 0.01 | 163 | 68 | 5 | 0.01 | 164 | 68 | 5 | Inv. |
| 8 | 8 | 0.01 | 165 | 69 | 0.04 | 5 | 0.01 | 164 | 69 | 5 | 0.01 | 165 | 69 | 5 | Inv. |
| 9 | 9 | 0.04 | 125 | 59 | 0.36 | 3 | 0.04 | 104 | 51 | 2 | 0.05 | 107 | 53 | 2 | Comp. |
| 10 | 10 | 0.01 | 166 | 70 | 0.03 | 5 | 0.01 | 164 | 69 | 5 | 0.01 | 165 | 69 | 5 | Inv. |
| 11 | 11 | 0.01 | 165 | 70 | 0.03 | 5 | 0.01 | 163 | 69 | 5 | 0.01 | 164 | 69 | 5 | Inv. |
| 12 | 12 | 0.01 | 162 | 69 | 0.03 | 5 | 0.01 | 160 | 69 | 5 | 0.01 | 164 | 70 | 5 | Inv. |
| 13 | 13 | 0.05 | 125 | 60 | 0.32 | 3 | 0.05 | 100 | 53 | 3 | 0.05 | 101 | 55 | 2 | Comp. |
| 14 | 14 | 0.04 | 125 | 62 | 0.35 | 3 | 0.04 | 100 | 55 | 3 | 0.05 | 101 | 55 | 2 | Comp. |
| 15 | 15 | 0.01 | 166 | 72 | 0.03 | 5 | 0.01 | 164 | 71 | 5 | 0.01 | 167 | 72 | 5 | Inv. |
| 16 | 16 | 0.01 | 166 | 71 | 0.02 | 5 | 0.01 | 164 | 71 | 5 | 0.01 | 167 | 72 | 5 | Inv. |

TABLE 4

| Sample No. | Emulsion No. | Intensifying screen 2 | | | | | | | | | | | | | |
|---|---|---|---|---|---|---|---|---|---|---|---|---|---|---|---|
| | | Processing-1 | | | | | Processing-2 | | | | Processing-3 | | | | |
| | | Fog | S | CP | PR | SIC | Fog | S | CP | SIC | Fog | S | CP | SIC | Remark |
| 1 | 1 | 0.05 | 61 | 55 | 0.32 | 2 | 0.05 | 52 | 50 | 1 | 0.05 | 54 | 50 | 1 | Comp. |
| 2 | 2 | 0.05 | 61 | 55 | 0.35 | 2 | 0.05 | 52 | 50 | 1 | 0.05 | 54 | 50 | 1 | Comp. |
| 3 | 3 | 0.05 | 70 | 50 | 0.36 | 1 | 0.05 | 61 | 43 | 1 | 0.05 | 62 | 45 | 1 | Comp. |
| 4 | 4 | 0.06 | 73 | 56 | 0.35 | 1 | 0.05 | 64 | 52 | 1 | 0.06 | 65 | 55 | 1 | Comp. |
| 5 | 5 | 0.05 | 73 | 57 | 0.36 | 1 | 0.05 | 64 | 51 | 1 | 0.05 | 65 | 54 | 1 | Comp. |
| 6 | 6 | 0.04 | 76 | 59 | 0.35 | 3 | 0.04 | 65 | 51 | 2 | 0.05 | 66 | 54 | 1 | Comp. |
| 7 | 7 | 0.01 | 100 | 68 | 0.05 | 5 | 0.01 | 99 | 68 | 5 | 0.01 | 100 | 68 | 5 | Inv. |
| 8 | 8 | 0.01 | 101 | 69 | 0.04 | 5 | 0.01 | 100 | 69 | 5 | 0.01 | 101 | 69 | 5 | Inv. |
| 9 | 9 | 0.04 | 76 | 59 | 0.36 | 3 | 0.04 | 63 | 51 | 2 | 0.05 | 65 | 53 | 2 | Comp. |
| 10 | 10 | 0.01 | 101 | 70 | 0.03 | 5 | 0.01 | 100 | 69 | 5 | 0.01 | 101 | 69 | 5 | Inv. |
| 11 | 11 | 0.01 | 101 | 70 | 0.03 | 5 | 0.01 | 99 | 69 | 5 | 0.01 | 100 | 69 | 5 | Inv. |
| 12 | 12 | 0.01 | 99 | 69 | 0.03 | 5 | 0.01 | 98 | 69 | 5 | 0.01 | 100 | 70 | 5 | Inv. |
| 13 | 13 | 0.05 | 76 | 60 | 0.32 | 3 | 0.05 | 61 | 53 | 3 | 0.05 | 62 | 55 | 2 | Comp. |
| 14 | 14 | 0.04 | 76 | 62 | 0.35 | 3 | 0.04 | 61 | 55 | 3 | 0.05 | 62 | 55 | 2 | Comp. |
| 15 | 15 | 0.01 | 101 | 72 | 0.03 | 5 | 0.01 | 100 | 71 | 5 | 0.01 | 102 | 72 | 5 | Inv. |
| 16 | 16 | 0.01 | 101 | 71 | 0.02 | 5 | 0.01 | 100 | 71 | 5 | 0.01 | 102 | 72 | 5 | Inv. |

As can be seen from Tables 3 and 4, inventive samples exhibited superior results to comparative samples.

What is claimed is:

1. A silver halide light sensitive photographic material comprising a support having thereon hydrophilic colloid layers including a silver halide emulsion layer, wherein (i) at least 50% of the total projected area of silver halide grains contained in the emulsion layer is accounted for by tabular grains having an aspect ratio of 3 to 15, (ii) said tabular grains each comprising an inner region which accounts for 70% by volume of the grain and a residual outer region, said outer region containing at least 75% of total iodide contained in the grain, and (iii) said tabular grains each having an outermost layer, a halide content distribution among the tabular grains with respect to the outermost layer being not more than 20%; and wherein at least one of the hydrophilic colloid layers contains a sulfur containing compound, which has a water-solubilizing group.

2. The silver halide photographic material of claim 1, wherein in (iii), said halide content is an iodide content.

3. The silver halide photographic material of claim 2, wherein said outermost layer contains is 0.1 to 10 mol % iodide.

4. The silver halide photographic material of claim 3 wherein said outermost layer contains 0.1 to 5 mol % iodide.

5. The silver halide photographic material of claim 1, wherein said outermost layer further contains at least 20 mol % bromide.

6. The silver halide photographic material of claim 5 wherein said outermost layer contains at least 50 mol % bromide.

7. The silver halide photographic material of claim 1, wherein said sulfur containing compound is represented by the following formula (1) or (2):

$$R^1—(S)m—R^2 \qquad \text{formula (1)}$$

wherein $R^1$ and $R^2$ each represent an aliphatic hydrocarbon group, an aromatic hydrocarbon group or a heterocyclic group, provided that at least one of $R^1$ and $R^2$ has a water-solubilizing group and $R^1$ and $R^2$ may combine with each other to form a ring; and m is an integer of 2 to 6, $$R—S(M)y \qquad \text{formula (2)}$$

wherein R represents an aliphatic hydrocarbon group, aromatic hydrocarbon group or heterocyclic group or an atomic group, each of which has a water-solubilizing group; M represents a hydrogen atom, an alkali metal atom or a cationic group; and y is 0 or 1, provided that when y is 0, the formula represents R═S, in which S is linked by a double bond to a carbon atom contained in the R.

8. The silver halide photographic material of claim 7 wherein said hydrophilic layers are on both sides of said support.

9. The silver halide photographic material of claim 8 wherein said sulfur containing compound is contained in said emulsion layer.

10. The silver halide photographic material of claim 1, wherein said sulfur compound is contained in the silver halide emulsion layer.

11. The silver halide photographic material of claim 1 wherein said hydrophilic layers are on both sides of said support.

12. The silver halide photographic material of claim 11 wherein said outermost layer contains at least 50 mol % bromide and 0.1 to 5 mol % iodide.

13. The silver halide photographic material of claim 1 wherein there are at least two distributions of halides in said outermost layer wherein each are a maximum of 20%.

14. The silver halide photographic material of claim 1 wherein said silver halide grains comprise silver iodobromide, silver iodochloride, or silver iodochlorobromide.

15. The silver halide photographic material of claim 1 wherein a width of grain size distribution is a maximum of 15%.

16. The silver halide photographic material of claim 15 wherein a width of grain thickness distribution is a maximum of 20%.

17. The silver halide photographic material of claim 1 wherein said sulfur containing compound is incorporated into the emulsion layer or a non-emulsion layer.

* * * * *